US008889326B2

(12) United States Patent
Sugiura

(10) Patent No.: US 8,889,326 B2
(45) Date of Patent: Nov. 18, 2014

(54) TONER, PROCESS CARTRIDGE, AND DEVELOPER

(71) Applicant: Hideki Sugiura, Shizuoka (JP)

(72) Inventor: Hideki Sugiura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 10 days.

(21) Appl. No.: 13/756,952

(22) Filed: Feb. 1, 2013

(65) Prior Publication Data

US 2013/0260297 A1 Oct. 3, 2013

(30) Foreign Application Priority Data

Mar. 30, 2012 (JP) ..... 2012-079060
Jun. 27, 2012 (JP) ..... 2012-144025

(51) Int. Cl.

| | |
|---|---|
| ***G03G 9/00*** | (2006.01) |
| ***G03G 21/18*** | (2006.01) |
| ***G03G 9/087*** | (2006.01) |
| ***G03G 9/08*** | (2006.01) |
| ***G03G 9/093*** | (2006.01) |
| ***G03G 9/097*** | (2006.01) |

(52) U.S. Cl.

CPC ..... *G03G 9/08755* (2013.01); *G03G 21/18* (2013.01); *G03G 9/0819* (2013.01); *G03G 9/0821* (2013.01); *G03G 9/0827* (2013.01); *G03G 9/08797* (2013.01); *G03G 9/09392* (2013.01); *G03G 9/09725* (2013.01); *G03G 9/09733* (2013.01)

USPC ..... 430/105; 430/108.1; 430/109.1; 430/109.4; 430/110.2; 430/110.4; 430/111.3; 399/111; 399/252

(58) Field of Classification Search

USPC ..... 430/45.54, 105, 108.1, 109.1, 109.4, 430/123.52, 123.55; 399/111, 252

See application file for complete search history.

(56) References Cited

U.S. PATENT DOCUMENTS

| | | | | |
|---|---|---|---|---|
| 2005/0089787 | A1 | 4/2005 | Uchinokura et al. | |
| 2005/0255399 | A1 | 11/2005 | Ichikawa et al. | |
| 2006/0024604 | A1 | 2/2006 | Sugiura et al. | |
| 2006/0063081 | A1 | 3/2006 | Nagatomo et al. | |
| 2006/0165989 | A1 | 7/2006 | Takikawa et al. | |
| 2006/0204883 | A1 | 9/2006 | Nakayama et al. | |
| 2006/0240351 | A1 | 10/2006 | Sugiura et al. | |
| 2007/0031748 | A1 | 2/2007 | Kotsugai et al. | |
| 2007/0059063 | A1 | 3/2007 | Nakayama et al. | |
| 2007/0140748 | A1 | 6/2007 | Sugiura | |
| 2008/0014527 | A1 | 1/2008 | Kotsugai et al. | |
| 2008/0096116 | A1 | 4/2008 | Utsumi et al. | |
| 2008/0268366 | A1 | 10/2008 | Nakayama et al. | |
| 2008/0305423 | A1 | 12/2008 | Sugiura et al. | |
| 2009/0117480 | A1* | 5/2009 | Yamada et al. | 430/108.2 |
| 2009/0123186 | A1 | 5/2009 | Sugiura et al. | |
| 2011/0097659 | A1 | 4/2011 | Sugiura et al. | |
| 2011/0159580 | A1* | 6/2011 | Kim et al. | 435/289.1 |
| 2011/0281209 | A1 | 11/2011 | Sugiura et al. | |
| 2011/0294064 | A1 | 12/2011 | Miyaake et al. | |
| 2012/0231387 | A1 | 9/2012 | Sugiura | |

FOREIGN PATENT DOCUMENTS

| | | |
|---|---|---|
| JP | 2008-040286 | 2/2008 |

* cited by examiner

*Primary Examiner* — Thorl Chea

(74) *Attorney, Agent, or Firm* — Oblon, Spivak, McClelland, Maier & Neustadt, L.L.P.

(57) ABSTRACT

A toner including a colorant, a resin, and a volatile organic compound in an amount from 1 to 200 μg/g is provided. The toner has a softening index Ct within a range from 70 to 100° C.

8 Claims, 5 Drawing Sheets

TONER, PROCESS CARTRIDGE, AND DEVELOPER

CROSS-REFERENCE TO RELATED APPLICATIONS

This patent application is based on and claims priority pursuant to 35 U.S.C. §119 to Japanese Patent Application Nos. 2012-079060 and 2012-144025, filed on Mar. 30, 2012 and Jun. 27, 2012, respectively, in the Japan Patent Office, the entire disclosure of each of which is hereby incorporated by reference herein.

BACKGROUND

1. Technical Field

The present disclosure relates to a toner, a process cartridge including the toner, and a developer including the toner.

2. Description of Related Art

An electrophotographic or electrostatic image forming apparatus generally forms an image by taking the following steps: forming an electrostatic latent image on a photoreceptor, developing the electrostatic latent image into a toner image with a toner, transferring the toner image onto a recording medium, and fixing the toner image thereon by application of heat. A full-color image is formed by superimposing toner images of black, yellow, magenta, and cyan one another on a recording medium and simultaneously fixing them on the recording medium by application of heat.

For the purpose of reducing global environmental load, toner is generally required to be fixable at much lower temperatures. To meet this requirement, there have been various attempts to lower the softening temperature of toner. However, it has also been revealed that the lowering of the softening temperature of toner undesirably degrades its fluidity, as well as developability and transferability, under high-temperature and high-humidity conditions.

On the other hand, it is known that low-temperature-fixable toners can be produced by processes using water and/or organic solvents. However, toners produced through such processes generally contain not small an amount of residual volatile contents, which is undesirable.

JP-2008-40286-A describes a toner binder resin prepared from ortho-phthalic acid in attempting to reduce residual volatile contents.

SUMMARY

In accordance with some embodiments, a toner including a colorant, a resin, and a volatile organic compound in an amount from 1 to 200 μg/g is provided. The toner has a softening index Ct within a range from 70 to 100° C.

In accordance with some embodiments, a process cartridge detachably attachable to image forming apparatus is provided. The process cartridge includes a latent image bearing member and a developing device integrated with the latent image bearing member. The developing device includes the above toner.

In accordance with some embodiments, a two-component developer including the above toner and a magnetic carrier is provided.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
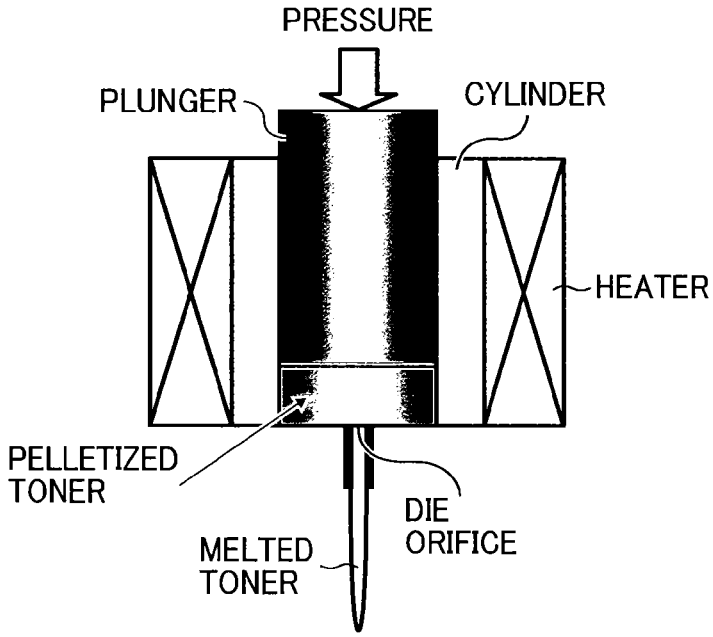
FIG. 1A is a schematic view of a flow tester that measures the softening index Ct.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

According to an embodiment, a toner including a colorant, a resin, and a volatile organic compound in an amount from 1 to 200 μg/g is provided. The toner has a softening index Ct within a range from 70 to 100° C.

According to an embodiment, the toner has a softening index Ct within a range from 70 to 100° C. In some embodiments, the toner has a softening index Ct within a range from 80 to 95° C.

The softening index Ct is determined in view of heat and pressure characteristics of toner. In this specification, the softening index Ct is defined by a flow beginning temperature Tfb measured by a flow tester with a load of 25 kg/cm$^2$. When the toner has a core-shell structure, the softening index Ct indicates viscoelasticity of the entire toner, especially of the core. The softening index Ct also indicates softening characteristic of the toner having been subjected to a sufficient load. In particular, the softening index Ct indicates softening characteristic of the core after the core-shell structure has been collapsed, based on an assumption that the toner has been applied with a sufficient amount of fixing pressure. When the softening index Ct is less than 70° C., the toner particles may soften too much even at low temperatures. As a result, their interparticle force may be increased and therefore their fluidity may be decreased in high-temperature and high-humidity conditions. When the softening index Ct is exceeding 100° C., the toner particles may be melted insufficiently at low temperatures, resulting in a toner image with a poor fixation strength. In addition, in low-temperature and low-humidity conditions, the toner particles may not be sufficiently fused with each other, resulting in a toner image with a poor fixation strength.

According to an embodiment, the toner includes a volatile organic compound in an amount from 1 to 200 μg/g. In some embodiments, the toner includes a volatile organic compound in an amount from 1 to 100 μg/g or from 1 to 50 μg/g. When the amount of the volatile organic compound is within a range from 1 to 200 μg/g, the increase of interparticle force and the decrease of fluidity are prevented in high-temperature and high-humidity conditions. When the amount of the volatile organic compound is less than 1 μg/g, the decrease of fluidity is prevented. However, the interparticle force is decreased too much even at low temperatures, resulting in a toner image with a poor fixation strength. When the amount of the volatile organic compound exceeds 200 μg/g, the fluidity of the toner decreases.

In some embodiments, the volatile organic compound is ethyl acetate. Such a slight amount of ethyl acetate accelerates the melting of the toner at low temperatures.

According to an embodiment, the toner further includes rice husk, a processed rice husk, and/or rice husk ash. These materials adsorb the volatile organic compound and prevent the volatile organic compound from volatilizing from the toner.

According to an embodiment, the resin includes a polyester resin. The toner including a polyester resin can be more flexibly designed in terms of low-temperature fixability and can be more easily controlled in terms of particle shape that has an effect on the fluidity. Thus, the toner including a polyester resin prevents the decrease of fluidity in high-temperature and high-humidity conditions. When the toner includes a crystalline polyester resin, such a toner can be much more flexibly designed in terms of low-temperature fixability. When the toner includes a modified polyester resin, such a toner can be much more easily designed in terms of low-temperature fixability.

According to an embodiment, the toner is produced by what is called a dissolution suspension method. The toner produced by the dissolution suspension method can be flexibly designed in terms of low-temperature fixability and can be easily controlled in terms of particle shape that has an effect on the fluidity. Thus, the toner produced by the dissolution suspension method prevents the decrease of fluidity in high-temperature and high-humidity conditions. The dissolution suspension method may by accompanied by an elongation reaction. In this case, the toner can be more flexibly designed in terms of low-temperature fixability and can be more easily controlled in terms of particle shape that has an effect on the fluidity.

According to another embodiment, the toner is produced by dispersing and/or emulsifying an oily phase containing toner constituents and/or precursors thereof and/or a monomer phase in an aqueous medium. According to another embodiment, the toner is produced by dispersing toner constituents including a polymer reactive with a compound having an active hydrogen group, a colorant, a release agent, etc., in an aqueous medium containing resin particles, and cross-linking and/or elongating the polymer in the aqueous medium. In these cases, the toner can be more easily designed in terms of low-temperature fixability.

In accordance with some embodiments, the toner has an average circularity E within a range from 0.93 to 0.99; the toner has a shape factor SF-1 within a range from 100 to 150 and another shape factor SF-2 within a range from 100 to 140; or a weight average particle diameter D4 of the toner is within a range from 2 to 7 μm and a ratio D4/Dn of the weight average particle diameter D4 to a number average particle diameter Dn is within a range from 1.00 to 1.25. Such a toner effectively prevents the decrease of fluidity in high-temperature and high-humidity conditions.

According to an embodiment, the toner can be used for an image forming apparatus equipped with a fixing device that fixes the toner on recording media by applying heat and pressure. In a case in which the image forming apparatus is employing a developing device comprised of tandemly-arranged four developing units each develop different-color images, the system speed is set within a range from 200 to 3,000 mm/sec, the surface pressure of the fixing medium is set within a range from 10 to 3,000 N/cm$^2$, and the fixing nip time is set within a range from 30 to 400 msec, the toner expresses proper fluidity and can be properly subjected to the processes of developing, transferring, and fixing although the system speed is set within that higher region. Additionally, the toner can be properly deformed or melted under high pressure to be properly fixed on recording media (e.g., paper) without causing hot offset. Within the above fixing nip time, the toner can be properly fixed on the recording media with consuming the minimum amount of electric power.

According to an embodiment, a process cartridge detachably attachable to image forming apparatus is provided. The process cartridge includes a latent image bearing member and a developing device integrated with the latent image bearing member. The developing device includes the above-described toner.

According to an embodiment, a two-component developer including the above-described toner and a magnetic carrier is provided. The two-component developer expresses proper fluidity and can be properly subjected to the process of developing and transferring even in high-temperature and high-humidity conditions. The two-component developer has high environmental stability or reliability.

Figure 1B:
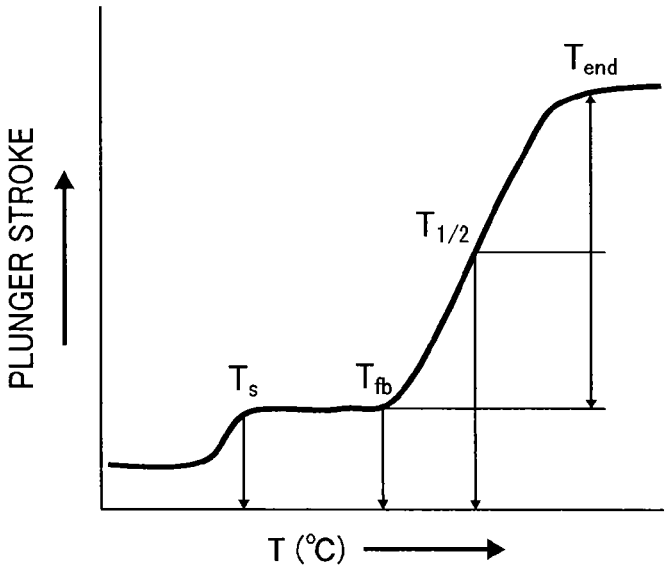
FIG. 1B is a graph showing a relation between the temperature and the plunger stroke of the flow tester.

The softening index Ct is measured by a flow tester CFT-500D available from Shimadzu Corporation. FIG. 1A is a schematic view of a flow tester that measures the softening index Ct. FIG. 1B is a graph showing a relation between the temperature and the plunger stroke.

The flow tester heats a pelletized toner under a load to allow the toner to melt and flow through a die orifice, as illustrated in FIG. 1A. The flow tester then measures the plunger stroke, as illustrated in FIG. 1B, to evaluate viscoelasticity (temperature dependency) of the toner. A temperature at which the plunger stroke is drastically changed is defined as a flow beginning temperature Tfb. A temperature at which the flow of the melted toner terminates is defined as a flow end temperature Tend.

Generally, the flow beginning temperature Tfb is measured under a relatively low load (several kg/cm$^2$) so the Tfb indicates heat characteristic of toner. According to an embodiment, the flow beginning temperature Tfb is measured under a relatively high load of 25 kg/cm$^2$ so the Tfb indicates heat and pressure characteristics of toner, both of which relate to fixability of the toner.

The measuring conditions are described below.

(1) Preparation of sample: Pelletize 1 g of toner into a cylindrical pellet having a diameter of 1 cm.

(2) Temperature condition: Heat from 50° C. to the flow end temperature Tend at a heating rate of 3° C./min.

(3) Die orifice diameter: 0.5 mm (4) Die length: 10 mm (5) Afterheat time: 200 s The amount of the volatile organic compound is determined by a cryotrap-GCMS method under the following conditions.

(1) Measuring instrument: QP2010 available from Shimadzu Corporation

Data analysis software: GCMSsolution available from Shimadzu Corporation

Heater: Py2020D available from Frontier Laboratories Ltd (2) Sample amount: 10 mg (3) Thermal extraction condition: Heating temperature: 180° C.

Heating time: 15 minutes (4) Cryotrap: −190° C.

(5) Column: Ultra ALLOY-5, L=30 m, ID=0.25 mm, Film=0.25 μm (6) Column heating profile: Keep at 60° C. for 1 minute, heat to 130° C. at a heating rate of 10° C./min, further heat to 300° C. at a heating rate of 20° C./min, and keep at 300° C. for 9.5 minutes.

(7) Carrier gas pressure: 56.7 kPa (constant)

(8) Column flow rate: 1.0 mL/min (9) Ionization method: EI method (70 eV)

(10) Mass range: m/z=29 to 700

(11) Benzene, styrene, and ethyl acetate are individually quantified. Other substances are simply quantified by being converted into toluene with reference to the total peak area from n-hexane (C6) peak to n-hexadecane (C16) peak.

Whether a toner has a core-shell structure or not is determined by the following procedure using a transmission electron microscope (TEM). The core-shell structure is defined as a structure comprised of a core and a shell layer covering the surface of the core. In some embodiments, the thickness of the shell layer is 50 nm or more.

First, embed one spatula of a toner in an epoxy resin. Expose the cured epoxy resin block containing the toner to a gas of ruthenium tetroxide, osmium tetroxide, or another dyeing agent for 1 minute to 24 hours to make the core and shell layer distinguishable according to the degree of dyeing. The exposure time is properly adjusted in view of the composition contrast between the core and shell to be observed with a TEM. Cut the epoxy resin block into ultrathin sections (having a thickness of about 200 nm) with an ultra microtome (ULTRACUT UCT from Leica) with a diamond knife. Observe the ultrathin sections with a TEM (H7000 from Hitachi High-Technologies Corporation) at an accelerating voltage of 100 kV. The dyeing procedure is not necessary in a case in which the shell layer and the core are distinguishable without being dyed. The composition contrast may be given by another means of selective etching, for example.

The average circularity E is defined by the following formula:

$$E(\%)=Cs/Cp\times 100$$

wherein Cp represents a peripheral length of a projected image of a particle and Cs represents a peripheral length of a circle having the same area as the projected image of the particle. The average circularity E is determined using a flow particle image analyzer FPIA-2100 (from Sysmex Corporation) and an analysis software FPIA-2100 Data Processing Program for FPIA version 00-10 as follows. First, charge a 100-mL glass beaker with 0.1 to 0.5 mL of a 10% surfactant (an alkylbenzene sulfonate NEOGEN SC-A from Dai-ichi Kogyo Seiyaku Co., Ltd.). Add 0.1 to 0.5 g of a toner to the beaker and mix with a micro spatula. Further add 80 mL of ion-exchange water to the beaker. Subject the resulting dispersion to a dispersion treatment for 3 minutes using an ultrasonic disperser (from Honda Electronics). Subject the dispersion, having a concentration of 5,000 to 15,000 particles per micro-liter, to a measurement of shape distribution by FPIA-2100. It is important that the dispersion has a concentration of 5,000 to 15,000 particles per micro-liter during the measurement in terms of measurement reproducibility. To make the dispersion have the desired concentration, the amount of surfactant or toner included in the dispersion is adjusted. When the amount of surfactant in the dispersion is too large, noisy bubbles are undesirably generated. When the amount of surfactant in the dispersion is too small, toner particles cannot sufficiently get wet or dispersed. The proper amount of toner in the dispersion depends on particle diameter of the toner. The smaller the particle diameter of toner, the smaller the proper amount of the toner. When a toner has a particle diameter within a range from 3 to 7 μm, 0.1 to 0.5 g of the toner should be included in the dispersion to make the dispersion have a concentration of 5,000 to 15,000 particles per micro-liter.

The shape factors SF-1 and SF-2 are measured as follows. Obtain images of 300 randomly-selected toner particles by a field emission scanning electron microscope FE-SEM S-4200 (from Hitachi, Ltd.). Analyze the images by an image analyzer LUZEX AP (from Nireco Corporation) through an interface and calculate SF-1 and SF-2 based on the following formulae. The measuring instruments are not limited to the combination of the FE-SEM and image analyzer LUZEX AP so long as SF-1 and SF-2 can be measured.

$$\text{SF-1}=(L^2/A)\times(\pi/4)\times 100$$

$$\text{SF-2}=(P^2/A)\times(1/4\pi)\times 100$$

wherein L represents an absolute maximum length of a projected toner particle, A represents an area of the projected toner particle, and P represents a peripheral length of the projected toner particle. SF-1 and SF-2 are both 100 when the particle shape is a complete sphere. SF-1 and SF-2 become greater than 100 as the particle shape gets far away from a complete sphere. SF-1 represents the degree of roundness of a toner particle and SF-2 represents the degree of asperity of the surface of a toner particle.

The weight average particle diameter (D4) and the number average particle diameter (Dn) are measured as follows. Usable measuring instruments include COULTER COUNTER TA-II and COULTER MULTIZIZER II (both from Beckman Coulter, Inc.). In this specification, D4 and Dn are measured by COULTER MULTIZIZER II.

First, add 0.1 to 5 mL of a surfactant (e.g., a polyoxyethylene alkyl ether (a nonionic surfactant)) to 100 to 150 mL of an electrolyte solution. The electrolyte solution is an aqueous solution of about 1% by weight of a first grade sodium chloride, such as ISOTON-II (from Beckman Coulter, Inc.). Next, add 2 to 20 mg of a toner to the electrolyte solution. Subject the electrolyte solution containing the toner to a dispersion treatment using an ultrasonic disperser for about 1 to 3 minutes to prepare a suspension. Subject the suspension to a measurement of volume and number distributions of toner particles using the above measuring instrument equipped with a 100-μm aperture. Calculate the weight average particle diameter (D4) and the number average particle diameter (Dn) from the volume and number distributions measured above.

The following 13 channels are employed during the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00

μm; and not less than 32.00 μm and less than 40.30 μm. Accordingly, particles having a particle diameter not less than 2.00 μm and less than 40.30 μm are objects to be measured.

The system speed B (mm/sec) of the image forming apparatus is determined from the following formula:

$$B\ (\text{mm/sec})=100\ (\text{sheets})\times 297\ (\text{mm})/A\ (\text{sec})$$

wherein A (sec) represents a length of time the image forming apparatus takes to continuously output images on 100 sheets of A4 paper (having a longitudinal length of 297 mm) in a longitudinal direction.

The surface pressure of the fixing medium is measured with a pressure distribution measurement system PINCH (from Nitta Corporation). The fixing nip time is calculated from the system speed and the fixing nip width.

Figure 2:
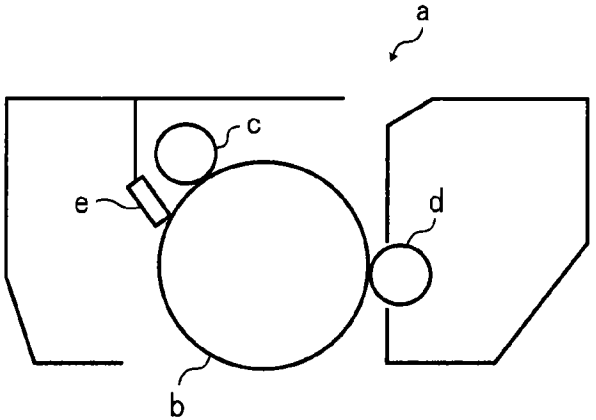
FIG. 2 is a schematic view of a process cartridge according to an embodiment.

FIG. 2 is a schematic view of a process cartridge according to an embodiment. A process cartridge (a) includes a photoreceptor (b), a charger (c), a developing device (d), and a cleaner (e).

According to an embodiment, a process cartridge integrally supports at least a photoreceptor and a developing device and is detachably attachable to image forming apparatuses.

According to an embodiment, the toner includes rice husk, a processed rice husk, and/or rice husk ash.

Rice husk is an agricultural waste produced in large amounts in separating rice from paddy. Rice husk is difficult to handle because it is not easily decomposed in normal soil. Therefore, rice husk is generally carbonized into rice husk ash that is usable as a bedding material for barns or a moisture adjuster for fertilizers.

Rice husk ash is a porous product obtained by thermally treating rice husk at a relatively low temperature (200° C. or less) and separating water and low-boiling-point substances. Rice husk is a gramineous plant containing a large amount of silicon dioxide. Therefore, the carbonized product thereof is a porous material (including 20% or less of carbonaceous material and 75% of silicon dioxide) which exhibits characteristics of both inorganic and organic porous materials. In thermally treating rice husk, an acidic liquid, i.e., rice husk vinegar, is distilled together with water. Rice husk vinegar has a pH within a range from 3 to 4 and has a toxic substance reduction effect and an insect repelling effect.

Rice husk ash is bulky and light and has a deodorizing effect and an organic substance adsorbing effect. Rice husk ash can adsorb a great amount of water even in relatively high-temperature and high-humidity conditions. Rice husk ash provides excellent adsorbing performance compared to other adsorbents or dehumidifying agents. For example, 100 g of rice husk ash adsorbs 200 g or more of water and becomes 300 g or more. Rice husk ash adsorbs the volatile organic compound in the toner and prevents it from volatilizing from the toner.

In some embodiments, rice husk ash having a micropore diameter within a range from 1 to 150 nm is included in the toner. Rice husk ash has a wider micropore diameter distribution than other charcoal substances and effectively adsorbs the volatile organic compound in the toner. When the micropore diameter is distributed beyond the above-described range, the kind and amount of substances to be adsorbed become more diverse, resulting in poorer adsorbing effect.

In some embodiments, the content of rice husk ash in the toner is within a range from 0.1 to 10 parts by weight based on 100 parts by weight of the binder resin. When the content falls below the above range, the volatile organic compound is not effectively adsorbed to the rice husk ash. When the content exceeds the above range, the binder resin may be hardened and low-temperature fixability of the toner may be degraded.

In some embodiments, rice husk vinegar is included in the toner for improving low-temperature fixability. Rice husk vinegar is an acidic liquid that is distilled together with water in its production process of thermally treating rice husk. Rice husk vinegar generally consists of 200 or more kinds of active natural substances including various organic acids, such as acetic acid, and small amounts of alcohols, ketones, and phenols. It is considered that such active natural substances have an effect of improving low-temperature fixability of the toner.

In some embodiments, the content of rice husk vinegar in the toner is within a range from 0.1 to 10 parts by weight. When the content falls below the above range, low-temperature fixability of the toner may not be sufficiently improved. When the content exceeds the above range, a greater amount of the volatile organic compound may be volatilized.

In some embodiments, rice husk is included in the toner, by finely dispersing the rice husk in water and/or an organic solvent, for improving low-temperature fixability and preventing the volatilization of the volatile organic compound.

In some embodiments, the content of rice husk in the toner is within a range from 0.1 to 20 parts by weight. When the content falls below the above range, the volatilization of the volatile organic compound is not sufficiently prevented. When the content exceeds the above range, low-temperature fixability of the toner may be degraded.

According to an embodiment, the toner includes a crystalline polyester resin. In some embodiments, the crystalline polyester resin has a melting point within a range from 50 to 100° C., from 55 to 90° C., or from 60 to 85° C. When the melting point falls below 50° C., storage stability of the toner and resulting fixed toner image may degrade. When the melting point exceeds 100° C., low-temperature fixability of the toner may be poor. The melting point of the crystalline polyester resin can be determined from a peak temperature observed in an endothermic curve obtained by differential scanning calorimetry (DSC).

In this specification, the crystalline polyester resin is defined as either a polymer consists of 100% of polyester units or a copolymer of polyester units with at most 50% by weight of other polymer units.

The crystalline polyester can be obtained from a polycondensation reaction between a polycarboxylic acid and a polyol. Either commercially-available products or laboratory-derived products of the crystalline polyester are usable.

Specific examples of usable polycarboxylic acids include, but are not limited to, aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as phthalic acid, isophthalic acid, terephthalic acid, naphthalene-2,6-dicarboxylic acid, malonic acid, mesaconic acid, and dibasic acids; and anhydrides and lower alkyl esters thereof.

Additionally, tri- or more valent polycarboxylic acids such as 1,2,4-benzenetricarboxylic acid, 1,2,5-benzenetricarboxylic acid, and 1,2,4-naphthalenetricarboxylic acid, and anhydrides and lower alkyl esters thereof are also usable.

Two or more of these materials can be used in combination.

Dicarboxylic acids having a sulfonic group or a double bond are also usable in combination with the above-described aliphatic and aromatic dicarboxylic acids.

Specific examples of usable polyols include, but are not limited to, aliphatic diols such as straight-chain aliphatic diols having 7 to 20 carbon atoms in the main chain. When a branched-chain aliphatic diol is used, the crystallinity and melting point of the resulting polyester resin may be too low. When the number of carbon atoms in the main chain is less than 7 and such a straight-chain aliphatic diol is reacted with an aromatic dicarboxylic acid, the melting point of the resulting polyester resin may be too high to be fixable at low temperatures. It is practically difficult to obtain straight-chain aliphatic diols having greater than 20 carbon atoms in the main chain. In some embodiments, the number of carbon atoms in the main chain is 14 or less.

Specific examples of usable aliphatic diols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanediol. Among these materials, 1,8-octanediol, 1,9-nonanediol, and 1,10-decanediol are easily available.

Additionally, tri- or more valent polyols such as glycerin, trimethylolethane, trimethylolpropane, and pentaerythritol are also usable.

Two or more of these materials can be used in combination.

In some embodiments, the polyol comprises the aliphatic diol in an amount of 80% by mole or more, or 90% by mole or more. When the amount of the aliphatic diol is less than 80% by mole, the crystallinity and melting point of the resulting polyester resin may be too low, thereby degrading toner blocking resistance, storage stability, and low-temperature fixability.

In order to adjust acid value and/or hydroxyl value, polycarboxylic acids and/or polyols may be added in the final stage of the polycondensation reaction.

Specific examples of usable polycarboxylic acids include, but are not limited to, aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenyl succinic anhydride, and adipic acid; and alicyclic carboxylic acids such as cyclohexanedicarboxylic acid.

Specific examples of usable polyols include, but are not limited to, aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as ethylene oxide adduct of bisphenol A and propylene oxide adduct of bisphenol A.

The polycondensation reaction for producing the crystalline polyester resin is performed at a temperature within a range from 180 to 230° C. while removing the produced water or alcohol as byproducts and optionally reducing the pressure.

When monomers are incompatible with each other under the reaction temperature, a high-boiling-point solvent can be used as a solubilization agent. In this case, the polycondensation reaction is performed while removing the solubilization agent. When copolymerizing a main monomer with a poorly-compatible monomer, the poorly-compatible monomer may be previously reacted with an acid or an alcohol to be reacted with both monomers, in advance of the reaction with the main monomer.

A catalyst can be used in the reaction for producing the crystalline polyester resin. Specific examples of usable catalysts include, but are not limited to, compounds of alkaline metals such as sodium and lithium; compounds of alkaline-earth metals such as magnesium and calcium; compounds of metals such as manganese, antimony, titanium, tin, zirconium, and germanium; phosphorous acid compounds; phosphate compounds; and amine compounds.

More specifically, usable catalysts include, but are not limited to, sodium acetate, sodium carbonate, lithium acetate, lithium carbonate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl) phosphite, ethyltriphenyl phosphonium bromide, triethylamine, and triphenylamine.

In some embodiments, the crystalline polyester resin has an acid value (i.e., the amount (mg) of KOH needed for neutralizing 1 g of the resin) within a range from 3.0 to 30.0 mgKOH/g, from 6.0 to 25.0 mgKOH/g, or from 8.0 to 20.0 mgKOH/g. When the acid value is less than 3.0 mgKOH/g, dispersibility in water may be poor. Such a resin is difficult to be used in wet granulation processes. Also, such a resin is too unstable to effectively produce toner particles. When the acid value exceeds 30.0 mgKOH/g, the resulting toner may be too hygroscopic to be resistant to environmental conditions.

In some embodiments, the crystalline polyester resin has a weight average molecular weight (Mw) within a range from 6,000 to 35,000. When the weight average molecular weight (Mw) is less than 6,000, the toner may undesirably penetrate into the surface of a recording medium and form a non-uniformly fixed toner image thereon. The fixed toner image may be poorly resistant to folding. When the weight average molecular weight (Mw) exceeds 35,000, the melt viscosity of the toner may be too high. The toner should be heated to a higher temperature so as to express a proper viscosity to be fusible on a recording medium, resulting in deterioration of low-temperature fixability.

The weight average molecular weight (Mw) can be measured by a gel permeation chromatography (GPC), for example, using a GPC instrument HLC-8120 (from Tosoh Corporation) and columns TSKgel Super HM-M (15 cm, from Tosoh Corporation) with THF solvent. The weight average molecular weight (Mw) is determined from a resulting chromatogram with reference to a molecular weight calibration curve complied from monodisperse polystyrene standard samples.

In some embodiments, the content of the crystalline polyester resin in the toner is within a range from 3 to 40% by weight, from 4 to 35% by weight, or from 5 to 30% by weight. When the content of the crystalline polyester resin is less than 3% by weight, low-temperature fixability may be poor. When the content of the crystalline polyester resin exceeds 40% by weight, the strength of the toner and fixed toner image and chargeability may be poor.

In some embodiments, the crystalline polyester resin comprises 50% by weight or more of a crystalline polyester resin produced from aliphatic monomers (hereinafter "crystalline aliphatic polyester resin"). In some embodiments, the crystalline aliphatic polyester resin comprises the aliphatic monomer units in an amount 60% by mole or more, or 90% by mole more. As described above, usable aliphatic monomers include aliphatic diols and dicarboxylic acids.

According to an embodiment, the toner includes an amorphous polyester resin. Usable amorphous polyester resins include both modified and unmodified amorphous polyester resins. In some embodiments, the toner includes both a modified amorphous polyester resin and an unmodified amorphous polyester resin.

A modified amorphous polyester resin can be obtained from a polyester prepolymer (A) having an isocyanate group. A polyester prepolymer (A) having an isocyanate group may be a reaction product of a polyester having an active hydrogen group with a polyisocyanate (3). The polyester is a polycondensation product of a polyol (1) with a polycarboxylic acid (2). The active hydrogen group may be, for example, a hydroxyl group (e.g., an alcoholic hydroxyl group, a phenolic hydroxyl group), an amino group, a carboxyl group, or a mercapto group.

The polyol (1) may be, for example, a diol (1-1) or a polyol (1-2) having 3 or more valences. In some embodiments, a diol (1-1) alone or a mixture of a diol (1-1) with a small amount of a polyol (1-2) having 3 or more valences are used.

Specific examples of the diol (1-1) include, but are not limited to, alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); alkylene oxide (e.g., ethylene oxide, propylene oxide, butylene oxide) adducts of the alicyclic diols; and alkylene oxide (e.g., ethylene oxide, propylene oxide, butylene oxide) adducts of the bisphenols. In some embodiments, an alkylene glycol having 2 to 12 carbon atoms or an alkylene oxide adduct of a bisphenol is used. In some embodiments, a mixture of an alkylene oxide adduct of a bisphenol and an alkylene glycol having 2 to 12 carbon atoms is used.

Specific examples of the polyol (1-2) having 3 or more valences include, but are not limited to, polyvalent aliphatic alcohols having 3 or more valences (e.g., glycerin, trimethylolethane, trimethylolpropane, pentaerythritol, sorbitol), polyphenols having 3 or more valences (e.g., trisphenol PA, phenol novolac, cresol novolac), and alkylene oxide adducts of the polyphenols having 3 or more valences.

The polycarboxylic acid (2) may be, for example, a dicarboxylic acid (2-1) or a polycarboxylic acid (2-2) having 3 or more valences. In some embodiments, a dicarboxylic acid (2-1) alone or a mixture of a dicarboxylic acid (2-1) with a small amount of a polycarboxylic acid (2-2) having 3 or more valences are used.

Specific examples of the dicarboxylic acid (2-1) include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., phthalic acid, isophthalic acid, terephthalic acid, naphthalenedicarboxylic acid). In some embodiments, an alkenylene dicarboxylic acid having 4 to 20 carbon atoms or an aromatic dicarboxylic acid having 8 to 20 carbon atoms is used.

Specific examples of the polycarboxylic acid (2-2) having 3 or more valences include, but are not limited to, aromatic polycarboxylic acids having 9 to 20 carbon atoms (e.g., trimellitic acid, pyromellitic acid). Additionally, anhydrides and lower alkyl esters (e.g., methyl ester, ethyl ester, isopropyl ester) of the above-described polycarboxylic acids are also usable as the polycarboxylic acid (2).

In some embodiments, the equivalent ratio [OH]/[COOH] of hydroxyl groups [OH] in the polyol (1) to carboxyl groups [COOH] in the polycarboxylic acid (1) is within a range from 2/1 to 1/1, from 1.5/1 to 1/1, or from 1.3/1 to 1.02/1.

Specific examples of the polyisocyanate (3) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., $\alpha,\alpha,\alpha',\alpha'$-tetramethylxylylene diisocyanate), isocyanurates, and the above polyisocyanates in which the isocyanate group is blocked with a phenol derivative, an oxime, or a caprolactam. Two or more of these compounds can be used in combination.

In some embodiments, the equivalent ratio [NCO]/[OH] of isocyanate groups [NCO] in the polyisocyanate (3) to hydroxyl groups [OH] in the polyester resin having a hydroxyl group is within a range from 5/1 to 1/1, from 4/1 to 1.2/1, or from 2.5/1 to 1.5/1. When the equivalent ratio [NCO]/[OH] exceeds 5, low-temperature fixability of the resulting toner may be poor. When the equivalent ratio [NCO]/[OH] is less than 1, hot offset resistance of the resulting toner may be poor because the content of urea in the modified polyester is too small.

In some embodiments, the content of the polyisocyanate (3) units in the polyester prepolymer (A) having an isocyanate group is within a range from 0.5 to 40% by weight, from 1 to 30% by weight, or from 2 to 20% by weight. When the content is less than 0.5% by weight, hot offset resistance, heat-resistant storage stability, and low-temperature fixability of the resulting toner may be poor. When the content exceeds 40% by weight, low-temperature fixability of the resulting toner may be poor.

In some embodiments, the average number of isocyanate groups included in one molecule of the polyester prepolymer (A) having an isocyanate group is 1 or more, within a range from 1.5 to 3, or within a range from 1.8 to 2.5. When the average number of isocyanate groups is less than 1, hot offset resistance of the resulting toner may be poor because the molecular weight of the resulting modified polyester is too small.

The polyester prepolymer (A) is cross-linked and/or elongated with an amine (B). The amine (B) may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmethane), alicyclic diamines (e.g., 4,4'-diamino-3,3'-dimethyldicyclohexylmethane, diaminocyclohexane, isophoronediamine), and aliphatic diamines (e.g., ethylenediamine, tetramethylenediamine, hexamethylenediamine).

Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline.

Specific examples of the amino mercaptan (B4) include, but are not limited to, aminoethyl mercaptan and aminopropyl mercaptan.

Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

In some embodiments, a diamine (B1) alone or a mixture of a diamine (B1) with a small amount of a polyamine (B2) having 3 or more valences is used.

To control the molecular weight of the resulting modified polyester, a reaction terminator can be used. Specific examples of usable reaction terminators include, but are not limited to, monoamines (e.g., diethylamine, dibutylamine, butylamine, laurylamine) and blocked monoamines (e.g., ketimine compounds).

In some embodiments, the equivalent ratio [NCO]/[NHx] of isocyanate groups [NCO] in the polyester prepolymer (A) to amino groups [NHx] in the amine (B) is within a range from 1/2 to 2/1, from 1/1.5 to 1.5/1, or from 1/1.2 to 1.2/1. When the equivalent ratio [NCO]/[NHx] exceeds 2 or less than ½, hot offset resistance of the resulting toner may be poor because the molecular weight of the resulting urea-modified polyester is too small.

In some embodiments, the toner further includes an unmodified amorphous polyester (C) other than a modified amorphous polyester obtained from the polyester prepolymer having an isocyanate group (A). The combination of the modified amorphous polyester and the unmodified amorphous polyester (C) improves low-temperature fixability of the toner and gloss uniformity of the resulting toner image.

Similar to the polyester prepolymer (A) having an isocyanate group, the unmodified amorphous polyester (C) may be a polycondensation product of the above-described polyol (1) with the above-described polycarboxylic acid (2).

The polyester prepolymer (A) having an isocyanate group and the unmodified amorphous polyester (C) may be at least partially compatible with each other so as to improve low-temperature fixability and hot offset resistance of the toner. In this case, the unmodified amorphous polyester (C) has a similar chemical composition to the polyester prepolymer (A) having an isocyanate group. In some embodiments, the weight ratio of the polyester prepolymer (A) having an isocyanate group to the unmodified amorphous polyester (C) is within a range from 5/95 to 75/25, from 10/90 to 25/75, from 12/88 to 25/75, or from 12/88 to 22/78. When the weight ratio of the polyester prepolymer (A) is less than 5% by weight, hot offset resistance, heat-resistant storage stability, and low-temperature fixability of the resulting toner may be poor.

In some embodiments, the unmodified amorphous polyester (C) has a peak molecular weight within a range from 1,000 to 30,000, from 1,500 to 10,000, or from 2,000 to 8,000. When the peak molecular weight is less than 1,000, heat-resistant storage stability of the toner may be poor. When the peak molecular weight exceeds 10,000, low-temperature fixability of the toner may be poor. In some embodiments, the unmodified amorphous polyester (C) has a hydroxyl value of 5 mgKOH/g or more, within a range from 10 to 120 mgKOH/g, or within a range from 20 to 80 mgKOH/g. When the hydroxyl value is less than 5, hot offset resistance and low-temperature fixability of the resulting toner may be poor. In some embodiments, the unmodified amorphous polyester (C) has an acid value within a range from 0.5 to 40 mgKOH/g or from 5 to 35 mgKOH/g. Within the above range, the resulting toner is likely to be negatively chargeable. When the acid and hydroxyl values are beyond the above-described range, the toner may produce defective images in high-temperature and high-humidity conditions or low-temperature and low-humidity conditions.

In some embodiments, the toner has a glass transition temperature (Tg) within a range from 40 to 70° C. or from 45 to 55° C. When Tg is less than 40° C., heat-resistant storage stability of the toner may be poor. When Tg is exceeding 70° C., low-temperature fixability of the toner may be poor. Owing to the presence of the polyester resin prepared by cross-linking and/or elongating reactions, the toner provides high storage stability even having a low Tg.

In some embodiments, the storage elastic modulus of the toner becomes 10,000 dyne/cm$^2$ at a temperature (TG') of 100° C. or more or within a range from 110 to 200° C., at a measuring frequency of 20 Hz. When the temperature (TG') is less than 100° C., hot offset resistance of the resulting toner may be poor.

In some embodiments, the viscosity of the toner becomes 1,000 poises at a temperature (Tη) of 180° C. or less or within a range from 90 to 160° C., at a frequency of 20 Hz. When the temperature (TO exceeds 180° C., low-temperature fixability of the resulting toner may be poor. In some embodiments, in view of low-temperature fixability and hot offset resistance, TG' is higher than Tη. In some embodiments, the difference between TG' and Tη is 10° C. In some embodiments, the difference between TG' and Tη is 20° C. or more. There is no upper limit for the difference between TG' and Tη. In some embodiments, in view of heat-resistant storage stability and low-temperature fixability, the difference between TG' and Tη is within a range from 0 to 100° C., from 10 to 90° C., or from 20 to 80° C.

According to an embodiment, the toner includes a vinyl resin. According to another embodiment, the toner includes a vinyl resin in its shell layer.

Specific examples of usable vinyl resins include, but are not limited to, styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

Usable vinyl resins further include polymers of styrene or styrene derivatives (e.g., polystyrene, poly-p-chlorostyrene, polyvinyl toluene), styrene-based copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, and polybutyl methacrylate.

According to an embodiment, the toner includes a colorant. Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

In some embodiments, the content of the colorant in the toner is within a range from 1 to 15% by weight or from 3 to 10% by weight.

The colorant may be combined with a resin to be used as a master batch.

Specific examples of usable resins for the master batch include, but are not limited to, the above-described modified and unmodified polyester resins, polymers of styrene or styrene derivatives (e.g., polystyrene, poly-p-chlorostyrene, polyvinyl toluene), styrene-based copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

The master batch may be obtained by mixing and kneading a resin and a colorant while applying a high shearing force. To increase the interaction between the colorant and the resin, an organic solvent may be used. More specifically, the maser batch may be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. When performing the mixing or kneading, a high shearing force dispersing device such as a three roll mill may be used.

According to an embodiment, the toner includes a release agent such as a wax. Specific examples of usable release agents include, but are not limited to, polyolefin waxes (e.g., polyethylene wax, polypropylene wax), long-chain hydrocarbons (e.g., paraffin wax, SASOL wax), and carbonyl-group-containing waxes. In some embodiments, carbonyl-group-containing waxes are used. Specific examples of the carbonyl-group-containing waxes include, but are not limited to, polyalkanoic acid esters (e.g., carnauba wax, montan wax, trimethylolpropane tribehenate, pentaerythritol tetrabehenate, pentaerythritol diacetate dibehenate, glycerin tribehenate, 1,18-octadecanediol distearate), polyalkanol esters (e.g., tristearyl trimellitate, distearyl maleate), polyalkanoic acid amides (e.g., ethylenediamine dibehenylamide), polyalkyl amides (e.g., trimellitic acid tristearylamide), and dialkyl ketones (e.g., distearyl ketone). In some embodiments, polyalkanoic acid esters are used.

In some embodiments, the release agent has a melting point within a range from 40 to 160° C., from 50 to 120° C., or from 60 to 90° C. When the melting point is less than 40° C., heat-resistant storage stability of the toner may be poor. When the melting point is exceeding 160° C., cold offset resistance of the toner may be poor. In some embodiments, the release agent has a melt-viscosity of within a range from 5 to 1,000 cps or from 10 to 100 cps, at a temperature 20° C. higher than the melting point. Waxes having a melt-viscosity greater than 1,000 cps poorly improve hot offset resistance and low-temperature fixability of the toner.

In some embodiments, the content of the release agent in the toner is within a range from 0 to 40% by weight or from 3 to 30% by weight.

According to an embodiment, the toner includes a charge controlling agent. Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives.

Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LRA-901 and LR-147 (boron complex), which are manufactured by Japan Carlit Co., Ltd.; and copper phthalocyanine, perylene, quinacridone, azo pigments, and polymers having a functional group such as a sulfonate group, a carboxyl group, and a quaternary ammonium group.

In some embodiments, the content of the charge controlling agent is within a range from 0.1 to 10 parts by weight or from 0.2 to 5 parts by weight, based on 100 parts by weight of the binder resin. When the content of charge controlling agent exceeds 10 parts by weight, the toner may be excessively charged and electrostatically attracted to a developing roller. As a result, the fluidity of the developer and resulting image density may deteriorate.

The charge controlling agent may be directly mixed with the binder resin or the master batch, or added to an organic solvent containing such toner components. Alternatively, the charge controlling agent may be fixed on the surface of the resulting toner particles.

According to an embodiment, the toner includes an external additive for improving fluidity, developability, and chargeability. Specific materials usable as the external additive include fine particles of oxides. Further, fine particles of inorganic materials or hydrophobized inorganic materials can be used. In some embodiments, the toner includes fine particles of a hydrophobized inorganic material having an average primary particle diameter within a range from 1 to 100 nm. In some embodiments, the toner includes fine particles of at least one kind of inorganic material having an average primary particle diameter within a range from 5 to 70 nm. In some embodiments, the toner includes fine particles of at least one kind of hydrophobized inorganic material having an average primary particle diameter of 20 nm or less and at least one kind of hydrophobized inorganic material having an average primary particle diameter of 30 nm or more. In some embodiments, the toner includes fine particles of the external additive having a BET specific surface area within a range from 20 to 500 $m^2/g$.

Specific examples of usable inorganic materials include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. In some embodiments, the toner includes silica and/or titanium dioxide.

In some embodiments, the toner includes fine particles of hydrophobized silica, titania, titanium oxide, or alumina. Specific examples of commercially available silica particles include, but are not limited to, HDK H 2000, HDK H 2000/4, HDK H 2050EP, HVK 21, and HDK H 1303 (from Hoechst AG); and R972, R974, RX200, RY200, R202, R805, and R812 (from Nippon Aerosil Co., Ltd.). Specific examples of commercially available titania particles include, but are not limited to, P-25 (from Nippon Aerosil Co., Ltd.); STT-30 and STT-65C-S (from Titan Kogyo, Ltd.); TAF-140 (from Fuji Titanium Industry Co., Ltd.); and MT-150W, MT-500B, MT-600B, and MT-150A (from TAYCA Corporation). Specific examples of commercially available hydrophobized titanium oxide particles include, but are not limited to, T-805 (from Nippon Aerosil Co., Ltd.); STT-30A and STT-65S-S (from Titan Kogyo, Ltd.); TAF-500T and TAF-1500T (from Fuji Titanium Industry Co., Ltd.); MT-100S and MT-100T (from TAYCA Corporation); and IT-S (from Ishihara Sangyo Kaisha, Ltd.).

Fine particles of hydrophobized oxides, silica, titania, and alumina can be obtained by treating fine particles of oxides, silica, titania, and alumina, which are hydrophilic, with a silane coupling agent, such as methyltrimethoxysilane, methyltriethoxysilane, and octyltrimethoxysilane.

Fine particles of silicone-oil-treated oxides and inorganic materials obtained by treating fine particles of oxides and inorganic materials with silicone oils, with application of heat if needed, are also usable as the external additive.

Specific examples of usable silicone oils include, but are not limited to, dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic-modified or methacrylic-modified silicone oil, and α-methylstyrene-modified silicone oil.

In some embodiments, the content of the external additive in the toner is within a range from 0.1 to 5% by weight or from 0.3 to 3% by weight. In some embodiments, fine particles having an average primary particle diameter of 100 nm or less or within a range from 3 to 70 nm are used as the external additive. When the average primary particle diameter is too small, the fine particles may be embedded in the toner without producing their effect. When the average primary particle diameter is too large, the fine particles may damage the photoreceptor non-uniformly.

Additionally, fine particles of polymers, such as polystyrene prepared by soap-free emulsion polymerization, suspension polymerization, or dispersion polymerization; copolymers of methacrylates or acrylates; polycondensation resins (e.g., silicone, benzoguanamine, nylon); and thermosetting resins, are also usable as the external additive.

The surface of such external additives may be hydrophobized so as to prevent deterioration of fluidity and chargeability even under high-humidity conditions. Specific examples of usable surface treatment agents include, but are not limited to, silane coupling agents, silylation agents, silane coupling agents having a fluorinated alkyl group, organic titanate coupling agents, aluminum coupling agents, silicone oils, and modified silicone oils.

The toner may further include a cleanability improving agent so as to be easily removable from a photoreceptor or a primary transfer medium when remaining thereon after image transfer. Specific examples of usable cleanability improving agents include, but are not limited to, metal salts of fatty acids (e.g., zinc stearate, calcium stearate), and fine particles of polymers prepared by soap-free emulsion polymerization (e.g., polymethyl methacrylate, polystyrene). In some embodiments, fine particles of a polymer having a relatively narrow size distribution and a volume average particle diameter within a range from 0.01 to 1 μm are used.

According to an embodiment, the toner further includes resin particles. In some embodiments, the resin particles have a glass transition temperature (Tg) within a range from 40 to 100° C. and a weight average molecular weight (Mw) within a range from 3,000 to 300,000. When Tg is less than 40° C. and/or Mw is less than 3,000, the toner has poor storage stability which may cause blocking when stored in a container or a developing device. When Tg is greater than 100° C. and/or Mw is exceeding 300,000, the resin particles may be poorly adhesive to paper, resulting in deterioration of low-temperature fixability of the toner.

In some embodiments, the toner includes the resin particles in an amount from 0.5 to 5.0% by weight. When the amount is less than 0.5% by weight, the toner has poor storage stability which may cause blocking when stored in a container or a developing device. When the amount is greater than 5.0% by weight, the resin particles may inhibit exuding of the release agent from the toner, resulting in deterioration of offset resistance of the toner. The amount of the resin particles can be determined by analyzing the toner with a pyrolysis gas chromatography mass spectrometer and quantifying the peak area corresponding to the resin particles observed in the resulting chromatogram.

The resin particles may be comprised of either a thermoplastic resin or a thermosetting resin so long as the fine resin particles are capable of forming an aqueous dispersion thereof. Specific examples of usable resins include, but are not limited to, vinyl resins, polylactic resins, polyurethane resins, epoxy resins, polyester resins, polyamide resins, polyimide resins, silicone resins, phenol resins, melamine resins, urea resins, aniline resins, ionomer resins, and polycarbonate resins. Among these resins, vinyl resins, polyurethane resins, epoxy resins, polyester resins, and combinations thereof are easy to form an aqueous dispersion of fine spherical particles thereof.

Specific examples of usable vinyl resins include, but are not limited to, homopolymers and copolymers of vinyl monomers, such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

In accordance with some embodiments, the toner is prepared as follows.

First, the prepolymer (A) having an isocyanate group is prepared by heating the polyol (1) and the polycarboxylic acid (2) to between 150 and 280° C. in the presence of an esterification catalyst (e.g., tetrabutoxy titanate, dibutyltin oxide) while removing the produced water by reducing pressure, if needed, to prepare a polyester having a hydroxyl group; and reacting a polyisocyanate (3) with the polyester.

An aqueous phase containing resin particles is prepared. The resin particles function as particle diameter controllers and are finally allocated on the surfaces of resulting toner particles forming shell layers. The properties of the shell layer depend on the particle diameter and chemical composition of the resin particles as well as properties of surfactants and solvents included in the aqueous phase.

The aqueous phase may include water alone or a mixture of water with a water-miscible solvent. Specific examples of usable water-miscible solvents include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

An organic solvent solution or dispersion of the polyester prepolymer (A) having an isocyanate group is prepared and is subjected to a reaction with the amine (B) in the aqueous phase to form toner particles. The organic solvent solution or dispersion of the polyester prepolymer (A) is dispersed (or emulsified) in the aqueous phase while applying a shearing force to form a stable aqueous dispersion of the polyester prepolymer (A). The organic solvent solution or dispersion of the polyester prepolymer (A) is mixed with other toner constituents, such as a colorant or colorant master batch, a release agent, and a charge controlling agent, at the time being dispersed (or emulsified) in the aqueous phase. Alternatively, all the toner constituents are previously mixed with each other and then the mixture is dissolved or dispersed in an organic solvent, and the resulting solution or dispersion of the toner constituents is dispersed (emulsified) in the aqueous phase at once. The toner constituents such as a colorant, a release agent, and a charge controlling agent are not necessarily included in the organic solvent solution or dispersion of the polyester prepolymer (A) at the time it is dispersed (or emulsified) in the aqueous phase, and may be added to the resulting particles in a later process. For example, it is possible to prepare particles including no colorants and then dye the particles with a colorant in a later process.

The organic solvent solution or dispersion of toner constituents (hereinafter "toner constituents liquid") is dispersed (or emulsified) in the aqueous phase using a low-speed shearing disperser, a high-speed shearing disperser, a frictional disperser, a high-pressure jet disperser, or an ultrasonic disperser, for example. In some embodiments, a high-speed shearing disperser is used to make the dispersing liquid droplets have an average particle diameter within a range from 2 to 20 μm. In such embodiments, the high-speed shearing disperser operates at a revolution within a range from 1,000 to 30,000 rpm or from 5,000 to 20,000 rpm. In some embodiments, the dispersing time is within a range from 0.1 to 5 minutes for a batch type disperser. In some embodiments, the dispersing temperature is within a range from 0 to 150° C. (under pressure) or from 40 to 98° C. As the temperature becomes higher, it is much easier to disperse (or emulsify) the toner constituents liquid in the aqueous phase because the viscosity of the toner constituents liquid becomes lower.

In some embodiments, the used amount of the aqueous phase is within a range from 50 to 2,000 parts by weight, or from 100 to 1,000 parts by weight, based on 100 parts by weight of the toner constituents including the polyester prepolymer (A). When the used amount of the aqueous phase is less than 50 parts by weight, the toner constituents may not be finely dispersed and the resulting toner particles may not have a desired particle size. When the used amount of the aqueous phase exceeds 2,000 parts by weight, manufacturing cost may increase. The aqueous phase may further contain a dispersant. The dispersant stabilizes the dispersion and makes the resulting particles have a narrower size distribution.

Specific examples of usable dispersants include, but are not limited to, anionic surfactants such as alkylbenzene sulfonate, α-olefin sulfonate, and phosphates; cationic surfactants such as amine salt type surfactants (e.g., alkylamine salts, amino alcohol fatty acid derivatives, polyamine fatty acid derivatives, imidazoline) and quaternary ammonium salt type surfactants (e.g., alkyl trimethyl ammonium salt, dialkyl dimethyl ammonium salt, alkyl dimethyl benzyl ammonium salt, pyridinium salt, alkyl isoquinolinium salt, and benzethonium chloride); nonionic surfactants such as fatty acid amide derivatives and polyvalent alcohol derivatives; and ampholytic surfactants such as alanine, dodecyldi(aminoethyl) glycine, di(octylaminoethyl) glycine, and N-alkyl-N,N-dimethyl ammonium betaine.

Surfactants having a fluoroalkyl group can achieve an effect in small amounts. Specific examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid diethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl(C6-C16) ethyl phosphates. Specific examples of commercially available anionic surfactants having a fluoroalkyl group include, but are not limited to, SURFLON® S-111, S-112, and S-113 (from AGC Seimi Chemical Co., Ltd.); FLUORAD FC-93, FC-95, FC-98, and FC-129 (from Sumitomo 3M); UNIDYNE DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific examples of usable cationic surfactants include, but are not limited to, aliphatic primary and secondary amine acids having a fluoroalkyl group; aliphatic quaternary ammonium salts such as perfluoroalkyl(C6-C10) sulfonamide propyl trimethyl ammonium salts; benzalkonium salts; benzethonium chlorides; pyridinium salts; and imidazolinium salts. Specific examples of commercially available cationic surfactants include, but are not limited to, SURFLON® S-121 (from AGC Seimi Chemical Co., Ltd.); FLUORAD FC-135 (from Sumitomo 3M); UNIDYNE DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

Poorly-water-soluble inorganic compounds such as tricalcium phosphate, calcium carbonate, titanium oxide, colloidal silica, and hydroxyapatite are also usable as the dispersant.

The aqueous phase may further contain a polymeric protection colloid to stabilize dispersing liquid droplets. Specific examples of usable polymeric protection colloids include, but are not limited to, homopolymers and copolymers obtained from monomers, such as acids (e.g., acrylic acid, methacrylic acid, α-cyanoacrylic acid, α-cyanomethacrylic acid, itaconic acid, crotonic acid, fumaric acid, maleic acid, maleic anhydride), hydroxyl-group-containing acrylates and methacrylates (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate), vinyl alcohols and vinyl alcohol ethers (e.g., vinyl methyl ether, vinyl ethyl ether, vinyl propyl ether), esters of vinyl alcohols with carboxyl-group-containing compounds (e.g., vinyl acetate, vinyl propionate, vinyl butyrate), amides (e.g., acrylamide, methacrylamide, diacetone acrylamide) and methylol compounds thereof (e.g., N-methylol acrylamide, N-methylol methacrylamide), acid chlorides (e.g., acrylic acid chloride, methacrylic acid chloride), and monomers containing nitrogen or a nitrogen-containing heterocyclic ring (e.g., vinyl pyridine, vinyl pyrrolidone, vinyl imidazole, ethylene imine); polyoxyethylenes (e.g., polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester); and celluloses (e.g., methyl cellulose, hydroxyethyl cellulose, hydroxypropyl cellulose).

In a case in which a dispersant soluble in acids and bases (e.g., calcium phosphate) is used, the resulting particles may be first washed with an acid (e.g., hydrochloric acid) and then washed with water to remove the dispersant. Alternatively, such a dispersant can be removed with an enzyme.

In some embodiments, the dispersant keeps remaining on the surface of the toner particle. In some embodiments, dispersants are removed from the surface of the toner particle in terms of chargeability.

In some embodiments, the elongation and/or cross-linking reaction time between the polyester prepolymer (A) and the amine (B) is within a range from 10 minutes to 40 hours or from 2 to 24 hours. In some embodiments, the reaction temperature is within a range from 0 to 150° C. or from 40 to 98° C. A catalyst can be used in the reaction, if needed. Specific examples of usable catalysts include, but are not limited to, dibutyltin laurate and dioctyltin laurate.

The organic solvent can be removed from the emulsion by gradually heating the emulsion to completely evaporate the organic solvent from liquid droplets. Alternatively, the organic solvent can be removed from the emulsion by spraying the emulsion into dry atmosphere to completely evaporate the organic solvent from liquid droplets. In this case, aqueous dispersants, if any, can also be evaporated. The dry atmosphere into which the emulsion is sprayed may be, for example, air, nitrogen gas, carbon dioxide gas, or combustion gas, which is heated to above the maximum boiling point among the used solvents. Such a treatment can be reliably performed by a spray drier, a belt drier, or a rotary kiln, within a short period of time. The organic solvent can also be removed by flowing air using a rotary evaporator.

The emulsion from which the organic solvent has been removed is then repeatedly subjected to a set of processes including crude centrifugal separation, washing in a tank, and drying by a hot air drier. Thus, toner particles are obtained. The toner particles may be further subjected to an aging process. In some embodiments, the aging temperature is within a range from 30 to 55° C. or from 40 to 50° C. and the aging time is within a range from 5 to 36 hours or from 10 to 24 hours.

In a case in which the emulsion is containing toner particles having a wide size distribution and is subjected to washing and drying treatments, the toner particles may be subjected to a classification treatment thereafter.

In the classification treatment, undesired-size particles are removed from the emulsion by means of cyclone separation, decantation, or centrifugal separation in wet conditions. Alternatively, the classification treatment can be performed after the emulsion is dried and toner particles are obtained, i.e., in dry conditions. The collected undesired-size particles, either in dry or wet condition, can be reused for preparation of toner particles. The dispersant may be removed from the emulsion as soon as possible, for example, in the process of the classification treatment.

The toner particles may be mixed with heterogeneous particles, such as a release agent, a charge controlling agent, and a fluidizer, upon application of mechanical impulsive force, so that the heterogeneous particles are fixed or fused on the surfaces of the toner particles.

Mechanical impulsive force can be applied by, for example, agitating the mixture of toner and heterogeneous particles with blades rotating at a high speed, or accelerating the mixture in a high-speed airflow to allow the toner and heterogeneous particles collide with a collision plate. Such a treatment can be performed by ONG MILL (from Hosokawa Micron Co., Ltd.), a modified I-TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

Finally, the toner particles are mixed with an external additive (e.g., inorganic fine particles) by a mixer (e.g., HENSCHEL MIXER) and coarse particles are removed therefrom by ultrasonic sieving. Thus, a toner is obtained.

According to an embodiment, a two-component developer is provided. The two-component developer includes a magnetic carrier and the above-described toner. In some embodiments, the two-component developer includes 100 parts by weight of a magnetic carrier and 1 to 10 parts by weight of the toner. The magnetic carrier may be comprised of, for example, iron powder, ferrite powder, magnetite powder, or magnetic resin particles, having a particle diameter about 20 to 200 μm.

Specific examples of usable covering materials for the magnetic carrier include, but are not limited to, amino resins (e.g., urea-formaldehyde resin, melamine resin, benzoguanamine resin, urea resin, polyamide resin, epoxy resin), polyvinyl and polyvinylidene resins (e.g., acrylic resin, polymethyl methacrylate resin, polyacrylonitrile resin, polyvinyl acetate resin, polyvinyl alcohol resin, polyvinyl butyral resin), styrene resins (e.g., polystyrene resin, styrene-acrylic copolymer resin), halogenated olefin resins (e.g., polyvinyl chloride), polyester resins (e.g., polyethylene terephthalate, polybutylene terephthalate), polycarbonate resins, polyethylene resins, polyvinyl fluoride resins, polyvinylidene fluoride resins, poly(trifluoroethylene) resins, poly(hexafluoropropylene) resins, vinylidene fluoride-acrylic copolymer, vinylidene fluoride-vinyl fluoride copolymer, tetrafluoroethylene-vinylidene fluoride-non-fluoride monomer terpolymer, and silicone resins.

The covering material may contain a conductive powder therein. Specific examples of usable conductive powders include, but are not limited to, metal, carbon black, titanium oxide, tin oxide, and zinc oxide. In some embodiments, the conductive powder has an average particle diameter of 1 μm or less. When the average particle diameter is greater than 1 μm, it may be difficult to control electric resistivity of the covering resin layer.

The toner may also be used as a magnetic or non-magnetic one-component developer consisting of the toner and no carrier.

According to an embodiment, a tandem full-color image forming apparatus having four tandemly-arranged developing units is provided.

Figure 3:
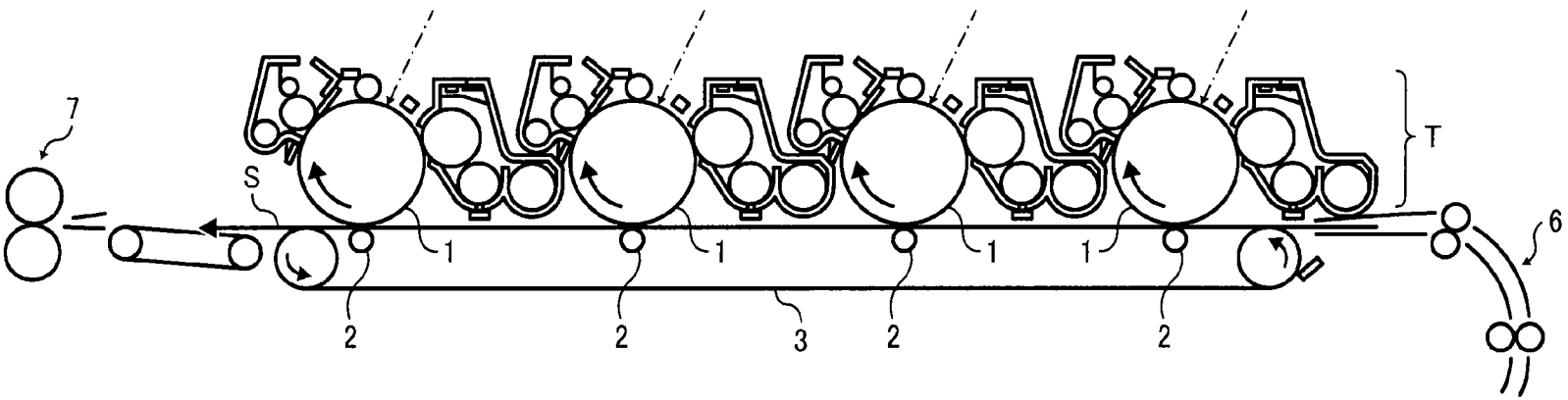
FIG. 3 is a schematic view of a tandem image forming apparatus which employs a direct transfer method according to an embodiment.
Figure 4:
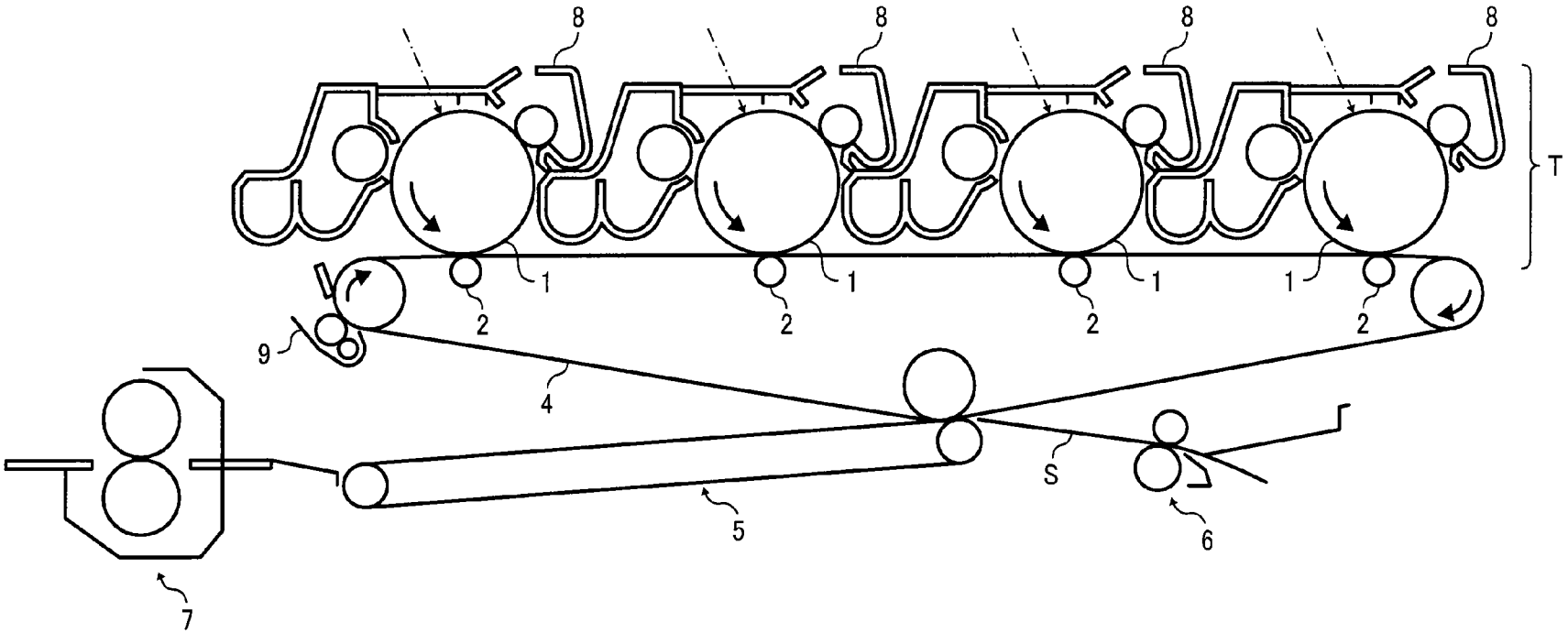
FIG. 4 is a schematic view of a tandem image forming apparatus which employs an indirect transfer method according to an embodiment.

FIG. 3 is a schematic view of a tandem image forming apparatus which employs a direct transfer method according to an embodiment. In FIG. 3, each transfer device 2 sequentially transfers a toner image from corresponding photoreceptor 1 directly onto a sheet S conveyed by a sheet conveyance belt 3. FIG. 4 is a schematic view of a tandem image forming apparatus which employs an indirect transfer method according to an embodiment. In FIG. 4, each primary transfer device 2 sequentially transfer a toner image from corresponding photoreceptor 1 onto an intermediate transfer member 4 to form a composite toner image thereon. A secondary transfer device 5 then transfers the composite toner image from the intermediate transfer member 5 onto a sheet S. The secondary transfer device 5 may be either in the form of a belt or a roller.

In the direct transfer method illustrated in FIG. 3, a paper feeder 6 and a fixing device 7 should be respectively positioned upstream and downstream from a tandem image forming unit T comprising the photoreceptors 1, thus making the image forming apparatus larger in a direction of conveyance of sheet. By contrast, in the indirect transfer method illustrated in FIG. 4, the secondary transfer device 5 can be positioned relatively freely. Therefore, the paper feeder 6 and the fixing device 7 can be provided overlapping the tandem image forming unit T, making the image forming apparatus more compact.

The image forming apparatus illustrated in FIG. 4 further includes photoreceptor cleaners 8 that remove residual toner particles remaining on the photoreceptors 1 after the primary transfer; and an intermediate transfer member cleaner 9 that removes residual toner particles remaining on the intermediate transfer member 4 after the secondary transfer.

Figure 5:
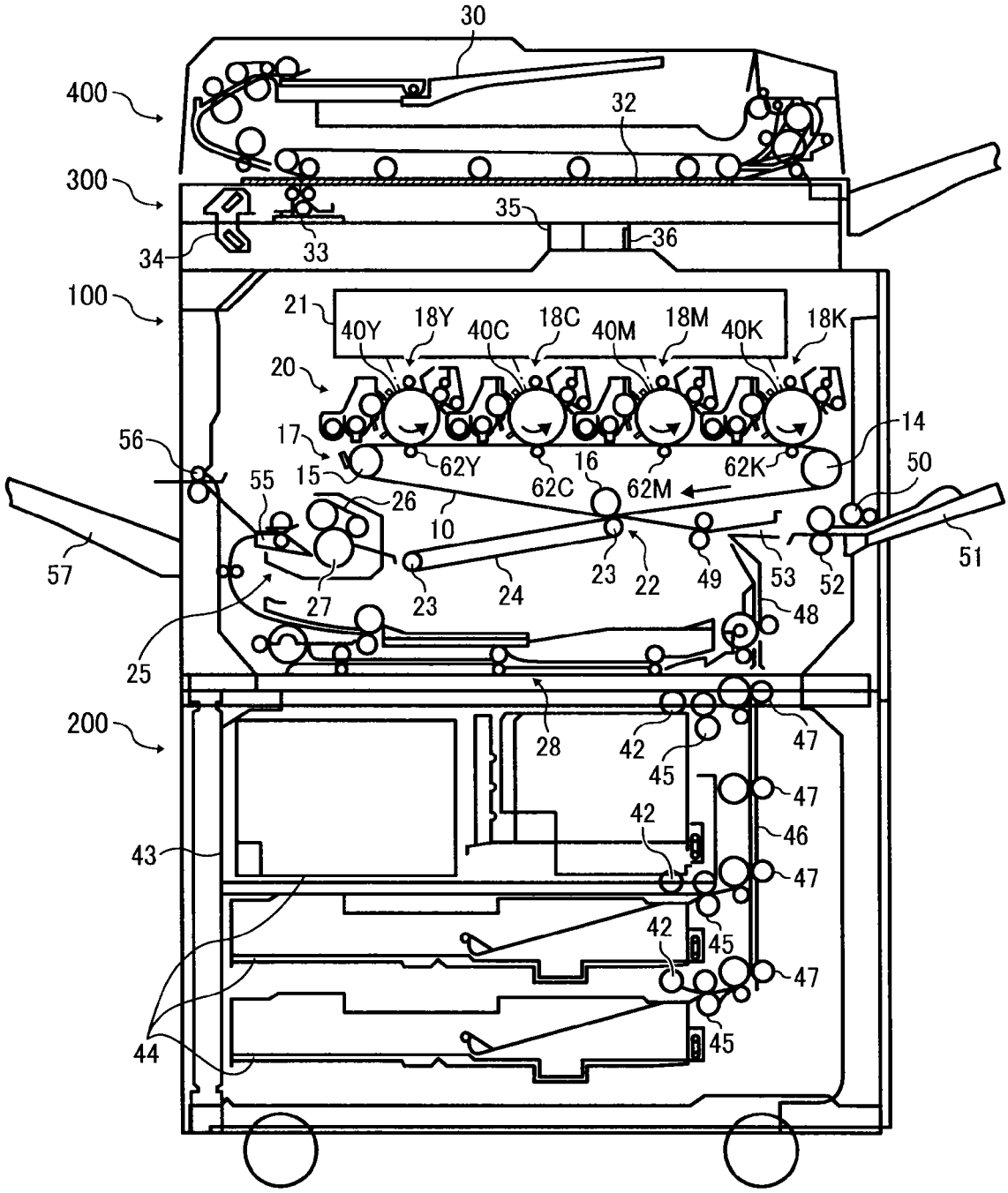
FIG. 5 is a schematic view of another tandem image forming apparatus which employs an indirect transfer method according to an embodiment.

FIG. 5 is a schematic view of another tandem image forming apparatus which employs an indirect transfer method according to an embodiment. The image forming apparatus includes a main body 100, a paper feed table 200 disposed below the main body 100, a scanner 300 disposed above the main body 100, and an automatic document feeder (ADF) 400 disposed above the scanner 300. An intermediate transfer member 10 that is in the form of a seamless belt is disposed at the center of the main body 100. The intermediate transfer member 10 is stretched across support rollers 14, 15, and 16 to be rotatable clockwise in FIG. 5. An intermediate transfer member cleaner 17 that removes residual toner particles remaining on the intermediate transfer member 10 is disposed on the left side of the support roller 15 in FIG. 5. Image forming units 18Y, 18C, 18M, and 18K that produce respective images of yellow, cyan, magenta, and black are disposed along a stretched surface of the intermediate transfer member 10 between the support rollers 15 and 14, thus forming a tandem image forming part 20.

An irradiator 21 is disposed immediately above the tandem image forming part 20. A secondary transfer device 22 is disposed on the opposite side of the tandem image forming part 20 relative to the intermediate transfer member 10. The secondary transfer device 22 includes a secondary transfer belt 24 that is in the form of a seamless belt stretched between two rollers 23. The secondary transfer belt 24 is pressed against the support roller 16 with the intermediate transfer member 10 therebetween so that an image is transferred from the intermediate transfer member 10 onto a sheet of a recording medium. A fixing device 25 that fixes a toner image on the sheet is disposed adjacent to the secondary transfer device 22. The fixing device 25 includes a fixing belt 26 that is in the form of a seamless belt and a pressing roller 27 that is pressed against the fixing belt 26. The secondary transfer device 22 has a function of conveying the sheet having the toner image thereon to the fixing device 25. The secondary transfer device 22 may be comprised of, for example, a transfer roller or a non-contact charger.

A sheet reversing device 28 that reverses a sheet upside down is disposed below the secondary transfer device 22 and the fixing device 25 and in parallel with the tandem image forming part 20.

To make a copy, a document is set on a document table 30 of the automatic document feeder 400. Alternatively, a document is set on a contact glass 32 of the scanner 300 while the automatic document feeder 400 is lifted up, followed by holding down of the automatic document feeder 400.

Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 directs light from a light source to a document, and reflects a light reflected from the document toward the second runner 34. A mirror in the second runner 34 reflects the light toward a reading sensor 36 through an imaging lens 35. Thus, the document is read.

On the other hand, upon pressing of the switch, one of the support rollers 14, 15, and 16 is driven to rotate by a driving motor and the other two support rollers are driven to rotate by rotation of the rotating support roller. Thus, the intermediate transfer member 10 is rotated and conveyed. In the image forming units 18Y, 18C, 18M, and 18K, single-color toner images of yellow, magenta, cyan, and black are formed on photoreceptors 40Y, 40C, 40M, and 40K, respectively. The single-color toner images are sequentially transferred onto the intermediate transfer member 10 as the intermediate transfer member 10 is conveyed. As a result, a composite full-color toner image is formed thereon.

On the other hand, upon pressing of the switch, one of paper feed rollers 42 starts rotating in the paper feed table 200 so that a sheet of a recording paper is fed from one of paper feed cassettes 44 in a paper bank 43. The sheet is separated by one of separation rollers 45 and fed to a paper feed path 46. Feed rollers 47 feed the sheet to a paper feed path 48 in the main body 100. The sheet is stopped by a registration roller 49. Alternatively, a sheet may be fed from a manual feed tray 51 by rotating a feed roller 50, separated by a separation roller 52, fed to a manual paper feed path 53, and stopped by the registration roller 49. The registration roller 49 feeds the sheet to between the intermediate transfer member 10 and the secondary transfer device 22 in synchronization with an entry of the composite full-color toner image formed on the intermediate transfer member 10 thereto.

The sheet is then fed to the fixing device 25 so that the composite full-color toner image is fixed thereon by application of heat and pressure. The sheet having the fixed toner image is switched by a switch claw 55 and discharged onto a discharge tray 57 by a discharge roller 56. Alternatively, the switch claw 55 switches paper feed paths so that the sheet gets reversed in the sheet reversing device 28. After forming another toner image on the back side of the sheet, the sheet is discharged onto the discharge tray 57 by rotating the discharge roller 56.

On the other hand, the intermediate transfer member cleaner 17 removes residual toner particles remaining on the intermediate transfer member 10 without being transferred onto the sheet. Thus, the tandem image forming part 20 gets ready for a next image formation.

Although the registration roller 49 is generally grounded, the registration roller 49 is applicable with a bias for the purpose of removing paper powders from the sheet.

Figure 6:
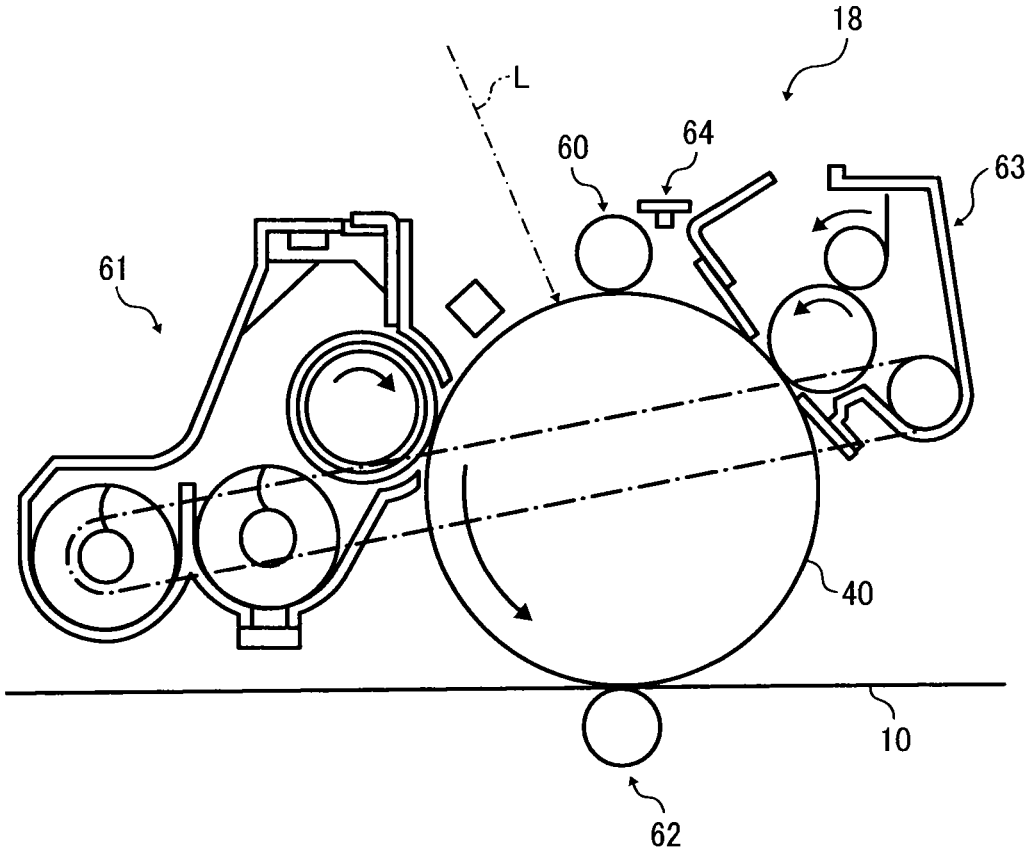
FIG. 6 is a magnified schematic view of an image forming unit included in the image forming apparatus illustrated in FIG. 5.

FIG. 6 is a magnified schematic view of one of the image forming units 18. The image forming unit 18 includes a photoreceptor 40; and a charger 60, a developing device 61, a primary transfer device 62, a photoreceptor cleaner 63, and a neutralizer 64, disposed around the photoreceptor 40.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

Preparation of Resin Particle Dispersion 1

Charge a reaction vessel equipped with a stirrer and a thermometer with 683 parts of water, 11 parts of a sodium salt of a sulfate of ethylene oxide adduct of methacrylic acid (ELEMINOL RS-30 from Sanyo Chemical Industries, Ltd.), 10 parts of a polylactic acid, 60 parts of styrene, 100 parts of methacrylic acid, 70 parts of butyl acrylate, and 1 part of ammonium persulfate. Agitate the mixture at a revolution of 3,800 rpm for 30 minutes, thus preparing a white emulsion. Heat the white emulsion to 75° C. and subject it to a reaction for 4 hours. Further add 30 parts of a 1% aqueous solution of ammonium persulfate to the emulsion and age the mixture at 75° C. for 6 hours. Thus, a resin particle dispersion 1 that is an aqueous dispersion of a vinyl resin (i.e., a copolymer of styrene, methacrylic acid, butyl acrylate, and a sodium salt of a sulfate of ethylene oxide adduct of methacrylic acid) is prepared. The resin particle dispersion 1 has a volume average particle diameter of 280 nm when measured by a laser diffraction particle size distribution analyzer LA-920 (from Horiba, Ltd.). The resin particle, isolated by drying a part of the resin particle dispersion 1, has a glass transition temperature (Tg) of 59° C. and a weight average molecular weight (Mw) of 60,000.

Preparation of Aqueous Phase 1

Mix 990 parts of water, 83 parts of the resin particle dispersion 1, 37 parts of a 48.3% aqueous solution of dodecyl diphenyl ether sodium disulfonate (ELEMINOL MON-7 from Sanyo Chemical Industries, Ltd.), and 90 parts of ethyl acetate. Thus, an aqueous phase 1 that is a milky whitish liquid is prepared.

Preparation of Amorphous Low-molecular-weight Polyester 1

Charge a reaction vessel equipped with a condenser, a stirrer, and a nitrogen inlet pipe with 229 parts of ethylene oxide 2 mol adduct of bisphenol A, 339 parts of propylene oxide 3 mol adduct of bisphenol A, 208 parts of terephthalic acid, 80 parts of adipic acid, 10 parts of succinic acid, and 2 parts of dibutyltin oxide. Subject the mixture to a reaction at 230° C. for 5 hours under normal pressures and subsequent 5 hours under reduced pressures of 10 to 15 mmHg. After adding 35 parts of trimellitic anhydride, further subject the mixture to a reaction at 180° C. for 1 hour. Thus, an amorphous low-molecular-weight polyester 1 is prepared. The amorphous low-molecular-weight polyester 1 has a number average molecular weight of 1,800, a weight average molecular weight (Mw) of 3,500, a glass transition temperature (Tg) of 38° C., and an acid value of 25 mgKOH/g.

Preparation of Amorphous Intermediate Polyester 1

Charge a reaction vessel equipped with a condenser, a stirrer, and a nitrogen inlet pipe with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. Subject the mixture to a reaction at 230° C. for 7 hours under normal pressures and subsequent 5 hours under reduced pressures of 10 to 15 mmHg. Thus, an amorphous intermediate polyester 1 is prepared. The amorphous intermediate polyester 1 has a number average molecular weight of 2,200, a weight average molecular weight (Mw) of 9,700, a glass transition temperature (Tg) of 54° C., an acid value of 0.5 mgKOH/g, and a hydroxyl value of 52 mgKOH/g.

Preparation of Prepolymer 1

Charge a reaction vessel equipped with a condenser, a stirrer, and a nitrogen inlet pipe with 410 parts of the amorphous intermediate polyester 1, 89 parts of isophorone diisocyanate, and 500 parts of ethyl acetate. Subject the mixture to a reaction at 100° C. for 5 hours. Thus, a prepolymer 1 is prepared. The prepolymer 1 is including 1.53% of free isocyanates.

Preparation of Ketimine Compound 1

Charge a reaction vessel equipped with a stirrer and a thermometer with 170 parts of isophoronediamine and 75 parts of methyl ethyl ketone. Subject the mixture to a reaction at 50° C. for 4 hours and a half. Thus, a ketimine compound 1 is prepared. The ketimine compound 1 has an amine value of 417 mgKOH/g.

Preparation of Master Batch 1

Mix 1,200 parts of water, 200 parts of a carbon black (PRINTEX 35 from Degussa, having a DBP oil absorption of 42 ml/100 mg and a pH of 9.5), 340 parts of a rice husk ash (passed 200 mesh), and 1,200 parts of a polyester resin by a HENSCHEL MIXER (from Nippon Coke & Engineering Co., Ltd.). Knead the resulting mixture at 110° C. for 1 hour by a double roll, roll and cool the kneaded mixture, and then pulverize the rolled mixture into particles by a pulverizer. Thus, a master batch 1 is prepared.

Preparation of Crystalline Polyester 1

Charge a reaction vessel equipped with a condenser, a stirrer, and a nitrogen inlet pipe with 1,200 parts of 1,6-hexanediol, 1,200 parts of decanedioic acid, and 0.4 parts of dibutyltin oxide. Replace the air in the vessel with an inert atmosphere of nitrogen gas by means of pressure reduction. Thereafter, mechanically agitate the mixture at a revolution of 180 rpm for 4 hours. Gradually heat the mixture to 210° C. under reduced pressures and agitate it for 1.5 hours. At the time the mixture becomes tenacious, air-cool the mixture to terminate the reaction. Thus, a crystalline polyester 1 is prepared. The crystalline polyester 1 has a number average molecular weight of 3,300, a weight average molecular weight (Mw) of 14,000, and a melting point of 65° C.

Preparation of Colorant Wax Dispersion 1

Charge a reaction vessel equipped with a stirrer and a thermometer with 378 parts of the amorphous low-molecular-weight polyester 1, 120 parts of a paraffin wax (having a melting point of 90° C.), 200 parts of the crystalline polyester 1, and 947 parts of ethyl acetate. Heat the mixture to 80° C. while agitating it, keep it at 80° C. for 5 hours, and cool it to 30° C. over a period of 1 hour. Further add 500 parts of the master batch 1 and 500 parts of ethyl acetate to the vessel and agitate the mixture for 1 hour.

Thereafter, subject 1,324 parts of the resulting mixture to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 msec. Repeat this dispersing operation 3 times (3 passes). Further add 1,324 parts of a 65% ethyl acetate solution of the amorphous low-molecular-weight polyester 1 and subject the resulting mixture to the above dispersing operation twice (2 passes). Thus, a colorant wax dispersion 1 is prepared. The solid content in the colorant wax dispersion 1 is 50% by weight.

Emulsification and Solvent Removal (Preparation of Dispersion Slurry 1)

Charge a vessel with 749 parts of the colorant wax dispersion 1, 120 parts of the prepolymer 1, and 3.5 parts of the ketimine compound 1. Agitate the mixture by a TK HOMOMIXER (from PRIMIX Corporation) at a revolution of 5,000 rpm for 5 minutes. Further add 1,200 parts of the aqueous phase 1 to the vessel and agitate the mixture by a TK HOMOMIXER at a revolution of 10,000 rpm for 1.5 hours. Thus, an emulsion slurry 1 is prepared.

Charge a vessel equipped with a stirrer and a thermometer with the emulsion slurry 1 and subject it to a solvent removal treatment at 30° C. for 8 hours and subsequently an aging treatment at 40° C. for 72 hours. Thus, a dispersion slurry 1 is prepared.

Washing and Drying (Preparation of Toner 1)

(1) Filter 100 parts of the dispersion slurry 1 under reduced pressures.

(2) Mix the filtration cake obtained in (1) with 100 parts of ion-exchange water by a TK HOMOMIXER at a revolution of 12,000 rpm for 10 minutes and subject the mixture to a filtration.

(3) Mix the filtration cake obtained in (2) with 100 parts of a 10% aqueous solution of sodium hydroxide by a TK HOMOMIXER at a revolution of 12,000 rpm for 30 minutes and subject the mixture to a filtration under reduced pressures.

(4) Mix the filtration cake obtained in (3) with 100 parts of a 10% hydrochloric acid by a TK HOMOMIXER at a revolution of 12,000 rpm for 10 minutes and subject the mixture to a filtration.

(5) Mix the filtration cake obtained in (4) with 300 parts of ion-exchange water by a TK HOMOMIXER at a revolution of 12,000 rpm for 10 minutes and subject the mixture to a filtration. Repeat this operation twice.

Thus, a filtration cake 1 is obtained. Dry the filtration cake 1 by a circulating drier at 45° C. for 48 hours and sieve it with a mesh having an opening of 75 μm. Thus, a mother toner 1 is prepared.

Mix 100 parts of the mother toner 1 with 1 part of a hydrophobized silica having a particle diameter of 13 nm by a HENSCHEL MIXER. Thus, a toner 1 is prepared. Properties of the toner 1 are shown in Table 1.

Example 2

Preparation of Resin Particle Dispersion Liquid 2

Charge a reaction vessel equipped with a stirrer and a thermometer with 683 parts of water, 11 parts of a sodium salt of a sulfate of ethylene oxide adduct of methacrylic acid (ELEMINOL RS-30 from Sanyo Chemical Industries, Ltd.), 10 parts of a polylactic acid, 70 parts of styrene, 90 parts of methacrylic acid, 60 parts of butyl acrylate, and 1 part of ammonium persulfate. Agitate the mixture at a revolution of 3,800 rpm for 30 minutes, thus preparing a white emulsion. Heat the white emulsion to 75° C. and subject it to a reaction for 3 hours. Further add 30 parts of a 1% aqueous solution of ammonium persulfate to the emulsion and age the mixture at 75° C. for 6 hours. Thus, a resin particle dispersion 2 that is an aqueous dispersion of a vinyl resin (i.e., a copolymer of styrene, methacrylic acid, butyl acrylate, and a sodium salt of a sulfate of ethylene oxide adduct of methacrylic acid) is prepared. The resin particle dispersion 2 has a volume average particle diameter of 153 nm when measured by a laser diffraction particle size distribution analyzer LA-920 (from Horiba, Ltd.). The resin particle, isolated by drying a part of the resin particle dispersion 2, has a glass transition temperature (Tg) of 59° C. and a weight average molecular weight (Mw) of 150,000.

Preparation of Master Batch 2

Mix 1,200 parts of water, 540 parts of a carbon black (PRINTEX 35 from Degussa, having a DBP oil absorption of 42 ml/100 mg and a pH of 9.5), and 1,200 parts of a polyester resin by a HENSCHEL MIXER (from Nippon Coke & Engineering Co., Ltd.). Knead the resulting mixture at 110° C. for 1 hour by a double roll, roll and cool the kneaded mixture, and then pulverize the rolled mixture into particles by a pulverizer. Thus, a master batch 2 is prepared.

Emulsification and Solvent Removal (Preparation of Dispersion Slurry 2)

Charge a vessel with 749 parts of the colorant wax dispersion 1, 120 parts of the prepolymer 1, and 3.5 parts of the ketimine compound 1. Agitate the mixture by a TK HOMOMIXER (from PRIMIX Corporation) at a revolution of 5,000 rpm for 5 minutes. Further add 1,000 parts of the aqueous phase 1 and 200 parts of a 20% aqueous solution of rice husk vinegar to the vessel and agitate the mixture by a TK HOMOMIXER at a revolution of 10,000 rpm for 1.5 hours. Thus, an emulsion slurry 2 is prepared.

Charge a vessel equipped with a stirrer and a thermometer with the emulsion slurry 2 and subject it to a solvent removal treatment at 30° C. for 8 hours and subsequently an aging treatment at 40° C. for 72 hours. Thus, a dispersion slurry 2 is prepared.

Preparation of Toner 2

Repeat the procedure for preparing the toner 1 in Example 1 except for replacing the resin particle dispersion 1, master batch 1, and dispersion slurry 1 with the resin particle dispersion 2, master batch 2, and dispersion slurry 2, respectively. Thus, a toner 2 is prepared. Properties of the toner 2 are shown in Table 1.

Example 3

Preparation of Resin Particle Dispersion 3

Charge a reaction vessel equipped with a stirrer and a thermometer with 683 parts of water, 11 parts of a sodium salt of a sulfate of ethylene oxide adduct of methacrylic acid (ELEMINOL RS-30 from Sanyo Chemical Industries, Ltd.), 10 parts of a polylactic acid, 60 parts of styrene, 100 parts of methacrylic acid, 70 parts of butyl acrylate, and 1 part of ammonium persulfate. Agitate the mixture at a revolution of 2,000 rpm for 20 minutes, thus preparing a white emulsion. Heat the white emulsion to 75° C. and subject it to a reaction for 3 hours. Further add 30 parts of a 1% aqueous solution of ammonium persulfate to the emulsion and age the mixture at 65° C. for 12 hours. Thus, a resin particle dispersion 3 that is an aqueous dispersion of a vinyl resin (i.e., a copolymer of styrene, methacrylic acid, butyl acrylate, and a sodium salt of a sulfate of ethylene oxide adduct of methacrylic acid) is prepared. The resin particle dispersion 3 has a volume average particle diameter of 640 nm when measured by a laser diffraction particle size distribution analyzer LA-920 (from Horiba, Ltd.). The resin particle, isolated by drying a part of the resin particle dispersion 3, has a glass transition temperature (Tg) of 59° C. and a weight average molecular weight (Mw) of 120,000.

Preparation of Amorphous Low-Molecular-Weight Polyester 3

Charge a reaction vessel equipped with a condenser, a stirrer, and a nitrogen inlet pipe with 430 parts of propylene oxide 2 mol adduct of bisphenol A, 300 parts of propylene oxide 3 mol adduct of bisphenol A, 257 parts of terephthalic acid, 65 parts of isophthalic acid, 10 parts of maleic anhydride, and 2 parts of titanium dihydroxybis(triethanolaminato) as a condensation catalyst. Subject the mixture to a reaction at 220° C. for 8 hours under nitrogen gas flow while reducing the produced water. Further subject the mixture to a reaction under reduced pressures of 5 to 20 mmHg. At the time the acid value becomes 7 mgKOH/g, take out the reaction product. Cool the reaction product to room temperature and pulverized it. Thus, an amorphous low-molecular-weight polyester 3 is prepared. The amorphous low-molecular-weight polyester 3 has a number average molecular weight of 6,020, a weight average molecular weight (Mw) of 25,600, a glass transition temperature (Tg) of 59° C., and an acid value of 8 mgKOH/g.

Preparation of Toner 3

Repeat the procedure for preparing the toner 1 in Example 1 except for replacing the resin particle dispersion 1 and amorphous low-molecular-weight polyester 1 with the resin particle dispersion 3 and amorphous low-molecular-weight polyester 3, respectively. Thus, a toner 3 is prepared. Properties of the toner 3 are shown in Table 1.

Example 4

Preparation of Resin Particle Dispersion 4

Charge a reaction vessel equipped with a stirrer and a thermometer with 683 parts of water, 11 parts of a sodium salt of a sulfate of ethylene oxide adduct of methacrylic acid (ELEMINOL RS-30 from Sanyo Chemical Industries, Ltd.), 10 parts of a polylactic acid, 70 parts of styrene, 90 parts of methacrylic acid, 60 parts of butyl acrylate, and 1 part of ammonium persulfate. Agitate the mixture at a revolution of 3,800 rpm for 30 minutes, thus preparing a white emulsion. Heat the white emulsion to 75° C. and subject it to a reaction for 3 hours. Further add 30 parts of a 1% aqueous solution of ammonium persulfate to the emulsion and age the mixture at 75° C. for 6 hours. Thus, a resin particle dispersion 4 that is an aqueous dispersion of a vinyl resin (i.e., a copolymer of styrene, methacrylic acid, butyl acrylate, and a sodium salt of a sulfate of ethylene oxide adduct of methacrylic acid) is prepared. The resin particle dispersion 4 has a volume average particle diameter of 153 nm when measured by a laser diffraction particle size distribution analyzer LA-920 (from Horiba, Ltd.). The resin particle, isolated by drying a part of the resin particle dispersion 4, has a glass transition temperature (Tg) of 59° C. and a weight average molecular weight (Mw) of 150,000.

Emulsification and Solvent Removal (Preparation of Dispersion Slurry 4)

Charge a vessel with 749 parts of the colorant wax dispersion 1, 120 parts of the prepolymer 1, and 3.5 parts of the ketimine compound 1. Agitate the mixture by a TK HOMOMIXER (from PRIMIX Corporation) at a revolution of 5,000 rpm for 5 minutes. Further add 1,000 parts of the aqueous phase 1 and 200 parts of a 20% aqueous solution of rice husk vinegar to the vessel and agitate the mixture by a TK HOMOMIXER at a revolution of 10,000 rpm for 1.5 hours. Thus, an emulsion slurry 4 is prepared.

Charge a vessel equipped with a stirrer and a thermometer with the emulsion slurry 4 and subject it to a solvent removal treatment at 30° C. for 8 hours and subsequently an aging treatment at 40° C. for 72 hours. Thus, a dispersion slurry 4 is prepared.

Preparation of Toner 4

Repeat the procedure for preparing the toner 1 in Example 1 except for replacing the resin particle dispersion 1 and dispersion slurry 1 with the resin particle dispersion 4 and dispersion slurry 4, respectively. Thus, a toner 4 is prepared. Properties of the toner 4 are shown in Table 1.

Example 5

Preparation of Resin Particle Dispersion 5

Charge a reaction vessel equipped with a stirrer and a thermometer with 683 parts of water, 11 parts of a sodium salt of a sulfate of ethylene oxide adduct of methacrylic acid (ELEMINOL RS-30 from Sanyo Chemical Industries, Ltd.), 10 parts of a polylactic acid, 60 parts of styrene, 100 parts of methacrylic acid, 70 parts of butyl acrylate, and 1 part of ammonium persulfate. Agitate the mixture at a revolution of 2,000 rpm for 20 minutes, thus preparing a white emulsion. Heat the white emulsion to 75° C. and subject it to a reaction for 3 hours. Further add 30 parts of a 1% aqueous solution of ammonium persulfate to the emulsion and age the mixture at 65° C. for 12 hours. Thus, a resin particle dispersion 5 that is an aqueous dispersion of a vinyl resin (i.e., a copolymer of styrene, methacrylic acid, butyl acrylate, and a sodium salt of a sulfate of ethylene oxide adduct of methacrylic acid) is prepared. The resin particle dispersion 5 has a volume average particle diameter of 640 nm when measured by a laser diffraction particle size distribution analyzer LA-920 (from Horiba, Ltd.). The resin particle, isolated by drying a part of the resin particle dispersion 5, has a glass transition temperature (Tg) of 59° C. and a weight average molecular weight (Mw) of 120,000.

Preparation of Master Batch 5

Mix 1,200 parts of water, 420 parts of a carbon black (PRINTEX 35 from Degussa, having a DBP oil absorption of 42 ml/100 mg and a pH of 9.5), 120 parts of a rice husk ash (passed 200 mesh), and 1,200 parts of a polyester resin by a HENSCHEL MIXER (from Nippon Coke & Engineering Co., Ltd.). Knead the resulting mixture at 110° C. for 1 hour by a double roll, roll and cool the kneaded mixture, and then pulverize the rolled mixture into particles by a pulverizer. Thus, a master batch 5 is prepared.

Preparation of Amorphous Low-Molecular-Weight Polyester 5

Charge a reaction vessel equipped with a condenser, a stirrer, and a nitrogen inlet pipe with 430 parts of propylene oxide 2 mol adduct of bisphenol A, 300 parts of propylene oxide 3 mol adduct of bisphenol A, 257 parts of terephthalic acid, 65 parts of isophthalic acid, 10 parts of maleic anhydride, and 2 parts of titanium dihydroxybis(triethanolaminato) as a condensation catalyst. Subject the mixture to a reaction at 220° C. for 8 hours under nitrogen gas flow while reducing the produced water. Further subject the mixture to a reaction under reduced pressures of 5 to 20 mmHg. At the time the acid value becomes 7 mgKOH/g, take out the reaction product. Cool the reaction product to room temperature and pulverized it. Thus, an amorphous low-molecular-weight polyester 5 is prepared. The amorphous low-molecular-weight polyester 5 has a number average molecular weight of 6,020, a weight average molecular weight (Mw) of 25,600, a glass transition temperature (Tg) of 59° C., and an acid value of 8 mgKOH/g.

Preparation of Toner 5

Repeat the procedure for preparing the toner 1 in Example 1 except for replacing the resin particle dispersion 1, master batch 1, and amorphous low-molecular-weight polyester 1 with the resin particle dispersion 5, master batch 5, and amorphous low-molecular-weight polyester 5, respectively. Thus, a toner 5 is prepared. Properties of the toner 5 are shown in Table 1.

Example 6

Preparation of Toner 6

Repeat the procedure for preparing the toner 1 in Example 1 except for changing the washing and drying procedures as follows. Thus, a toner 6 is prepared. Properties of the toner 6 are shown in Table 1.

Washing and Drying (1) Filter 100 parts of the dispersion slurry 1 under reduced pressures.

(2) Mix the filtration cake obtained in (1) with 100 parts of ion-exchange water by a TK HOMOMIXER at a revolution of 12,000 rpm for 10 minutes and subject the mixture to a filtration.

(3) Mix the filtration cake obtained in (2) with 100 parts of a 10% aqueous solution of sodium hydroxide by a TK HOMOMIXER at a revolution of 12,000 rpm for 30 minutes and subject the mixture to a filtration under reduced pressures.

(4) Mix the filtration cake obtained in (3) with 100 parts of a 10% hydrochloric acid by a TK HOMOMIXER at a revolution of 12,000 rpm for 10 minutes and subject the mixture to a filtration.

(5) Mix the filtration cake obtained in (4) with 300 parts of ion-exchange water by a TK HOMOMIXER at a revolution of 12,000 rpm for 10 minutes and subject the mixture to a filtration. Repeat this operation 5 times.

Thus, a filtration cake 6 is obtained. Dry the filtration cake 6 by a circulating drier for 48 hours at 45° C. and for subsequent 96 hours at 40° C., and sieve it with a mesh having an opening of 75 μm. Thus, a mother toner 6 is prepared.

Mix 100 parts of the mother toner 6 with 1 part of a hydrophobized silica having a particle diameter of 13 nm by a HENSCHEL MIXER. Thus, a toner 6 is prepared.

Example 7

Preparation of Toner 7

Repeat the procedure for preparing the toner 1 in Example 1 except for replacing the resin particle dispersion 1 with a resin particle dispersion 7 prepared as follows. Thus, a toner 7 is prepared. Properties of the toner 7 are shown in Table 1.

Preparation of Resin Particle Dispersion 7

Charge a reaction vessel equipped with a stirrer and a thermometer with 683 parts of water, 11 parts of a sodium salt of a sulfate of ethylene oxide adduct of methacrylic acid (ELEMINOL RS-30 from Sanyo Chemical Industries, Ltd.), 10 parts of a polylactic acid, 10 parts of styrene, 150 parts of methacrylic acid, 60 parts of butyl acrylate, and 1 part of ammonium persulfate. Agitate the mixture at a revolution of 3,800 rpm for 30 minutes, thus preparing a white emulsion. Heat the white emulsion to 75° C. and subject it to a reaction for 2 hours. Further add 30 parts of a 1% aqueous solution of ammonium persulfate to the emulsion and age the mixture at 75° C. for 6 hours. Thus, a resin particle dispersion 7 that is an aqueous dispersion of a vinyl resin (i.e., a copolymer of styrene, methacrylic acid, butyl acrylate, and a sodium salt of a sulfate of ethylene oxide adduct of methacrylic acid) is prepared. The resin particle dispersion 7 has a volume average particle diameter of 40 nm when measured by a laser diffraction particle size distribution analyzer LA-920 (from Horiba, Ltd.). The resin particle, isolated by drying a part of the resin particle dispersion 7, has a glass transition temperature (Tg) of 55° C. and a weight average molecular weight (Mw) of 40,000.

Comparative Example 1

Preparation of Master Batch 8

Mix 1,200 parts of water, 540 parts of a carbon black (PRINTEX 35 from Degussa, having a DBP oil absorption of 42 ml/100 mg and a pH of 9.5), and 1,200 parts of a polyester resin by a HENSCHEL MIXER (from Nippon Coke & Engineering Co., Ltd.). Knead the resulting mixture at 110° C. for 0.5 hours by a double roll, roll and cool the kneaded mixture, and then pulverize the rolled mixture into particles by a pulverizer. Thus, a master batch 8 is prepared.

Preparation of Toner 8

Repeat the procedure for preparing the toner 1 in Example 1 except for replacing the master batch 1 with the master batch 8. Thus, a toner 8 is prepared. Properties of the toner 8 are shown in Table 1.

Comparative Example 2

Preparation of Amorphous Polyester 9

Charge a reaction vessel equipped with a condenser, a stirrer, and a nitrogen inlet pipe with 229 parts of ethylene oxide 2 mol adduct of bisphenol A, 339 parts of propylene oxide 3 mol adduct of bisphenol A, 275 parts of terephthalic acid, 20 parts of adipic acid, 3 parts of succinic acid, and 2 parts of dibutyltin oxide. Subject the mixture to a reaction at 230° C. for 5 hours under normal pressures and subsequent 6 hours under reduced pressures of 10 to 15 mmHg. After adding 35 parts of trimellitic anhydride, further subject the mixture to a reaction at 180° C. for 1 hour. Thus, an amorphous polyester 9 is prepared. The amorphous polyester 9 has a number average molecular weight of 4,500, a weight average molecular weight (Mw) of 11,000, a glass transition temperature (Tg) of 62° C., and an acid value of 24 mgKOH/g.

Preparation of Toner 9

Premix toner constituents (described below) by a HENSCHEL MIXER (FM20C from Mitsui Mining and Smelting Co., Ltd.) at a peripheral speed of 30 msec for 120 seconds, followed by a pause for 60 seconds. Repeat this operation three times. Further mix 10 parts of ultrafine toner particles previously collected. Knead the mixture by a double roll at a surface temperature of 95° C. for 45 minutes. After rolling and cooling the kneaded mixture and coarsely pulverize the rolled mixture into particles, finely pulverize the particles by a jet mill pulverizer (1-2 type mill from Nippon Pneumatic MFG Co, Ltd.) and classify the particles by a wind power classifier (DS classifier from Nippon Pneumatic MFG Co, Ltd.) using swirl flow. Thus, bluish colored particles are obtained.

Pulverize the colored particles by a mechanical rotary pulverizer (TURBO MILL T-400RS from Freund-Turbo Corporation) at a process speed of 10 kg/h, a process temperature of 53° C., and a rotor peripheral speed of 113 m/s. Repeat this operation three times. Thus, the circularities of the colored particles are adjusted.

Mix 100 parts of the colored particles with 1 part of a hydrophobized silica having a particle diameter of 13 nm by a HENSCHEL MIXER. Thus, a toner 9 is prepared. Properties of the toner 9 are shown in Table 1.

(Toner Constituents)

Amorphous polyester 8: 100 parts

C.I. Pigment Blue 15: 3:5 parts)

Charge controlling agent (zinc bis(3,5-di-t-butylsalicylato-O1,O2)): 2 parts

Carnauba wax (WA-03 from To a Kasei Co., Ltd., having a melting point of 81° C.): 3 parts

Comparative Example 3

Preparation of Aqueous Phase 10

Mix 1,013 parts of water, 60 parts of the resin particle dispersion 1, 37 parts of a 48.3% aqueous solution of dodecyl diphenyl ether sodium disulfonate (ELEMINOL MON-7 from Sanyo Chemical Industries, Ltd.), and 90 parts of ethyl acetate. Thus, an aqueous phase 10 that is a milky whitish liquid is prepared.

Preparation of Amorphous Low-Molecular-Weight Polyester 10

Charge a reaction vessel equipped with a condenser, a stirrer, and a nitrogen inlet pipe with 229 parts of ethylene oxide 2 mol adduct of bisphenol A, 329 parts of propylene oxide 3 mol adduct of bisphenol A, 208 parts of terephthalic acid, 80 parts of adipic acid, and 2 parts of dibutyltin oxide. Subject the mixture to a reaction at 230° C. for 7 hours under normal pressures and subsequent 5 hours under reduced pressures of 10 to 15 mmHg. After adding 35 parts of trimellitic anhydride, further subject the mixture to a reaction at 180° C. for 2 hours. Thus, an amorphous low-molecular-weight polyester 10 is prepared. The amorphous low-molecular-weight polyester 10 has a number average molecular weight of 2,000, a weight average molecular weight (Mw) of 3,800, a glass transition temperature (Tg) of 40° C., and an acid value of 25 mgKOH/g.

Preparation of Toner 10

Repeat the procedure for preparing the toner 1 in Example 1 except for replacing the aqueous phase 1 and amorphous low-molecular-weight polyester 1 with the aqueous phase 10 and amorphous low-molecular-weight polyester 10, respectively. Thus, a toner 10 is prepared. Properties of the toner 10 are shown in Table 1.

Comparative Example 4

Preparation of Amorphous Low-Molecular-Weight Polyester 11

Charge a reaction vessel equipped with a condenser, a stirrer, and a nitrogen inlet pipe with 350 parts of ethylene oxide 2 mol adduct of bisphenol A, 326 parts of propylene oxide 3 mol adduct of bisphenol A, 278 parts of terephthalic acid, 40 parts of phthalic anhydride, and 2 parts of titanium dihydroxybis(triethanolaminato) as a condensation catalyst. Subject the mixture to a reaction at 220° C. for 8 hours under nitrogen gas flow while reducing the produced water. Further subject the mixture to a reaction under reduced pressures of 5 to 20 mmHg. At the time the acid value becomes 2 mgKOH/g, cool the mixture to 180° C. and add 62 parts of trimellitic anhydride. Subject the mixture to a reaction under normal pressure in a sealed condition for 2 hours and then take out the reaction product. Cool the reaction product to room temperature and pulverized it. Thus, an amorphous low-molecular-weight polyester 11 is prepared. The amorphous low-molecular-weight polyester 11 has a number average molecular weight of 4,020, a weight average molecular weight (Mw) of 93,800, a glass transition temperature (Tg) of 68° C., and an acid value of 35 mgKOH/g.

Preparation of Toner 11

Repeat the procedure for preparing the toner 1 in Example 1 except for replacing the amorphous low-molecular-weight polyester 1 with the amorphous low-molecular-weight polyester 11. Thus, a toner 11 is prepared. Properties of the toner 11 are shown in Table 1.

TABLE 1

| | Core-shell structure | Softening index Ct (° C.) | Content of volatile organic compound (μg/g) | Average circularity E | Shape factors SF-1 | Shape factors SF-2 | Particle size D4 (μm) | Particle size Dn (μm) | D4/Dn |
|---|---|---|---|---|---|---|---|---|---|
| Example 1 | Observed | 84 | 48 | 0.97 | 128 | 120 | 4.4 | 4.2 | 1.05 |
| Example 2 | Observed | 71 | 192 | 0.96 | 130 | 123 | 4.1 | 3.9 | 1.06 |
| Example 3 | Observed | 98 | 18 | 0.98 | 117 | 110 | 3.3 | 2.7 | 1.22 |
| Example 4 | Observed | 72 | 26 | 0.97 | 129 | 122 | 4.2 | 3.6 | 1.17 |
| Example 5 | Observed | 99 | 198 | 0.95 | 141 | 138 | 5.2 | 4.6 | 1.13 |
| Example 6 | Observed | 80 | 1 | 0.96 | 125 | 118 | 4.3 | 4.0 | 1.08 |

TABLE 1-continued

| | Core-shell structure | Softening index Ct (° C.) | Content of volatile organic compound (μg/g) | Average circularity E | Shape factors SF-1 | Shape factors SF-2 | Particle size D4 (μm) | Particle size Dn (μm) | Particle size D4/Dn |
|---|---|---|---|---|---|---|---|---|---|
| Example 7 | N/A | 70 | 35 | 0.98 | 112 | 107 | 6.3 | 5.6 | 1.13 |
| Comparative Example 1 | Observed | 83 | 230 | 0.97 | 129 | 121 | 4.6 | 4.1 | 1.12 |
| Comparative Example 2 | N/A | 97 | 0.4 | 0.93 | 162 | 150 | 6.8 | 5.6 | 1.21 |
| Comparative Example 3 | Observed | 68 | 191 | 0.94 | 154 | 135 | 5.4 | 4.3 | 1.26 |
| Comparative Example 4 | Observed | 102 | 173 | 0.94 | 152 | 141 | 7.1 | 5.9 | 1.20 |

Examples 11 to 17 and Comparative Examples 11 to 14

Preparation of Carrier

Subject coating materials (described below) to a dispersion treatment by a stirrer for 10 minutes to prepare a coating liquid. Apply the coating liquid to a core material (described below) by a fluidized bed coater equipped with a rotary bottom disc and agitation blades that generates swirling flow. Burn the core material having the coating in an electric furnace at 250° C. for 2 hours. Thus, a carrier is prepared. The carrier has an average particle diameter of 35 μm and a silicone resin coating having an average thickness of 0.5 μm.

(Core Material)

Mn ferrite particle (having a weight average particle diameter of 35 μm): 5,000 parts (Coating Materials)

Toluene: 450 parts

Silicone resin (SR2400 from Dow Corning Toray Co., Ltd., including 50% of non-volatile contents): 450 parts Aminosilane (SH6020 from Dow Corning Toray Co., Ltd.): 10 parts Carbon black: 10 parts Preparation of Two-Component Developers Uniformly mix and frictionally charge 7 parts of each of the toners 1 to 11 with 100 parts of the carrier by a TURBULA MIXER that agitates a sample in a vessel by tumbling the vessel. Thus, two-component developers of Examples 11 to 17 Comparative Examples of 11 to 14 are prepared.

Evaluations of Two-Component Developers

Evaluate the above-prepared two-component developers with a test machine A (described below). Further evaluate the two-component developer of Example 11 with a test machine B (described below) as Example 18. The evaluation results are shown in Table 2.

Both the test machines A and B are prepared by modifying IMAGIO MP C6000 (from Ricoh Co., Ltd.) as follows.

Preparation of Test Machine A

Adjust the linear speed to 350 mm/sec. In the fixing unit, adjust the fixing surface pressure and fixing nip time to 40 N/cm$^2$ and 40 ms, respectively. Adjust the surface of the fixing medium by applying a tetrafluoroethylene-perfluoroalkyl vinyl ether resin (PFA) thereto. Adjust the heating temperature of the fixing unit to 130° C.

Preparation of Test Machine B

Replace or adjust the development, transfer, cleaning, and conveyance units so that the linear speed gets 2,200 mm/sec. In the fixing unit, adjust the fixing surface pressure and fixing nip time to 110 N/cm$^2$ and 130 ms, respectively. Adjust the surface of the fixing medium by applying a tetrafluoroethylene-perfluoroalkyl vinyl ether resin (PFA) thereto. Adjust the heating temperature of the fixing unit to 140° C.

(1) Evaluation of Low-Temperature Fixability Under Low-Temperature and Low-Humidity Condition Print an image chart having an image area of 3% on 10,000 sheets of paper (TYPE 6200 from Ricoh, Co., Ltd.) under a low-temperature and low humidity condition, i.e., 10° C., 15% RH. Thereafter, print an image while changing the fixing temperature by 5° C.

Obtain a printed image having an image density of 1.2 when measured by a densitometer X-RITE 938 (from X-Rite) at each of the fixing temperatures.

Subject the printed images to rubbing for 50 times by a crock meter equipped with a sand eraser. Measure the image density before and after the rubbing and determine the fixation rate from the following formula:

$$\text{Fixation rate (\%)} = ID(A)/ID(B) \times 100$$

wherein ID(A) represents an image density after the rubbing and ID(B) represents an image density before the rubbing.

The minimum fixable temperature is defined as a temperature below which the fixation rate falls below 70%. The low-temperature fixability is graded into the following ranks.

A: The minimum fixable temperature is lowered by 15 to 20° C. than in the unmodified machine (IMAGIO MP C6000). Very good.

B: The minimum fixable temperature is lowered by 5 to 10° C. than in the unmodified machine (IMAGIO MP C6000). Good.

C: Comparable level to the unmodified machine (IMAGIO MP C6000).

D: The minimum fixable temperature is higher than in the unmodified machine (IMAGIO MP C6000). Poor.

(2) Evaluation of Fluidity Under High-Temperature and High-Humidity Condition

Set a powder tester (PT-N from Hosokawa Micron Corporation) in a high-temperature and high-humidity condition, i.e., 35° C., 70% RH. Feed 2.0 g of each toner on sieves (plain-woven metallic meshes based on HS Z8801-1) each having an opening of 150 μm, 75 μm, and 45 μm and determine the fluidity from the following formula:

$$\text{Fluidity (\%)} = \{(A+0.6B+0.2C)/2.0\} \times 100$$

wherein A (g) represents a remaining sample amount on the sieve having an opening of 150 μm, B (g) represents a remaining sample amount on the sieve having an opening of 75 μm, and C (g) represents a remaining sample amount on the sieve having an opening of 45 μm. The smaller the fluidity, the better. The fluidity is graded into the following ranks.

A: not greater than 10

B: greater than 10 and not greater than 20

C: greater than 20 and not greater than 30

D: greater than 30

TABLE 2

| | Low-temperature Fixability under Low-temperature and Low-humidity Condition | Fluidity under High-temperature and High-humidity Condition |
|---|---|---|
| Example 11 | B | B |
| Example 12 | A | C |
| Example 13 | C | A |
| Example 14 | A | A |
| Example 15 | C | C |
| Example 16 | C | C |
| Example 17 | C | A |
| Example 18 | C | C |
| Comparative Example 11 | B | D |
| Comparative Example 12 | D | C |
| Comparative Example 13 | B | D |
| Comparative Example 14 | D | C |

Additional modifications and variations in accordance with further embodiments of the present invention are possible in light of the above teachings. It is therefore to be understood that within the scope of the appended claims the invention may be practiced other than as specifically described herein.

What is claimed is:

1. A toner, comprising:

a colorant;

a resin;

ethyl acetate in an amount from 1 to 200 μg per 1 g of the toner; and at least one member selected from the group consisting of rice husk, a processed rice husk, and rice husk ash, wherein the toner has a softening index Ct within a range from 70 to 100° C.

2. The toner according to claim 1, wherein the resin includes at least one member selected from the group consisting of a polyester resin, a crystalline polyester resin, and a modified polyester resin.

3. The toner according to claim 1, wherein the toner has a core-shell structure.

4. The toner according to claim 1, wherein the toner has an average circularity E within a range from 0.93 to 0.99.

5. The toner according to claim 1, wherein the toner has a shape factor SF-1 within a range from 100 to 150 and another shape factor SF-2 within a range from 100 to 140.

6. The toner according to claim 1, wherein a weight average particle diameter D4 of the toner is within a range from 2 to 7 μm and a ratio D4/Dn of the weight average particle diameter D4 to a number average particle diameter Dn is within a range from 1.00 to 1.25.

7. A process cartridge detachably attachable to image forming apparatus, comprising:

a latent image bearing member; and a developing device integrated with the latent image bearing member, the developing device including the toner according to claim 1.

8. A two-component developer, comprising:

the toner according to claim 1; and a magnetic carrier.

* * * * *